US010459401B2

(12) United States Patent
Hijikata et al.

(10) Patent No.: US 10,459,401 B2
(45) Date of Patent: Oct. 29, 2019

(54) IMAGE FORMING APPARATUS

(71) Applicant: CANON KABUSHIKI KAISHA, Tokyo (JP)

(72) Inventors: Shunsuke Hijikata, Yokohama (JP); Yuichiro Inaba, Chigasaki (JP); Toshiyuki Watanabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/898,054

(22) Filed: Feb. 15, 2018

(65) Prior Publication Data

US 2018/0246466 A1 Aug. 30, 2018

(30) Foreign Application Priority Data

Feb. 24, 2017 (JP) ..... 2017-033246

(51) Int. Cl.

| | |
|---|---|
| ***G03G 21/18*** | (2006.01) |
| ***G03G 15/08*** | (2006.01) |
| ***G03G 15/04*** | (2006.01) |
| ***G03G 15/16*** | (2006.01) |
| ***G03G 15/01*** | (2006.01) |

(52) U.S. Cl.

CPC ..... *G03G 21/1853* (2013.01); *G03G 15/0121* (2013.01); *G03G 15/04054* (2013.01); *G03G 15/0865* (2013.01); *G03G 15/1605* (2013.01); *G03G 21/1814* (2013.01); *G03G 2215/066* (2013.01)

(58) Field of Classification Search

CPC ..... G03G 21/1814; G03G 21/1839; G03G 21/1842; G03G 21/1853; G03G 15/04036–04072

See application file for complete search history.

(56) References Cited

U.S. PATENT DOCUMENTS

| | | | | | |
|---|---|---|---|---|---|
| 5,729,809 | A * | 3/1998 | Haneda | G03G 15/0152 | 399/110 |
| 6,134,403 | A * | 10/2000 | Haneda | G03G 15/0152 | 399/107 |
| 2004/0165910 | A1* | 8/2004 | Sato | G03G 21/1835 | 399/116 |

FOREIGN PATENT DOCUMENTS

| | | | |
|---|---|---|---|
| JP | 2001-356548 | A | 12/2001 |
| JP | 2004-279551 | A | 10/2004 |
| JP | 2004301944 | A | 10/2004 |
| JP | 2006-235656 | A | 9/2006 |
| JP | 2008158381 | A | 7/2008 |
| JP | 2008-296379 | A | 12/2008 |
| JP | 4345802 | B2 | 10/2009 |
| JP | 2012208362 | A | 10/2012 |

* cited by examiner

*Primary Examiner* — Carla J Therrien

(74) *Attorney, Agent, or Firm* — Canon U.S.A., Inc. IP Division

(57) ABSTRACT

An image forming apparatus is provided, in which a light emission unit is disposed upstream from a belt in the insertion direction. In a state where the insertion of a cartridge into the apparatus main body is completed, in the normal direction to the surface of the belt, a distance from the surface of the transfer member to the rotational shaft of a photosensitive drum is longer than a distance from the surface of the belt to an image forming position where light emitted by the light emission unit forms an image on the surface of the photosensitive drum.

7 Claims, 23 Drawing Sheets

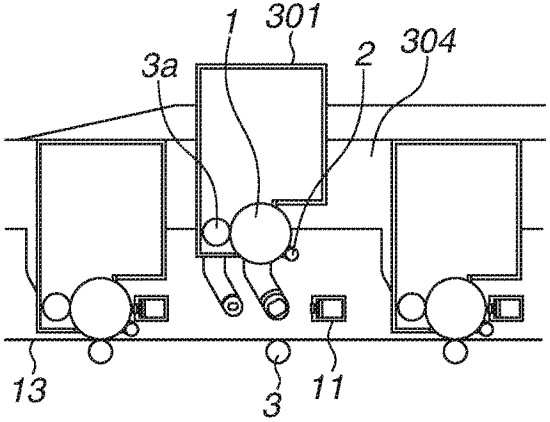
FIG.23A
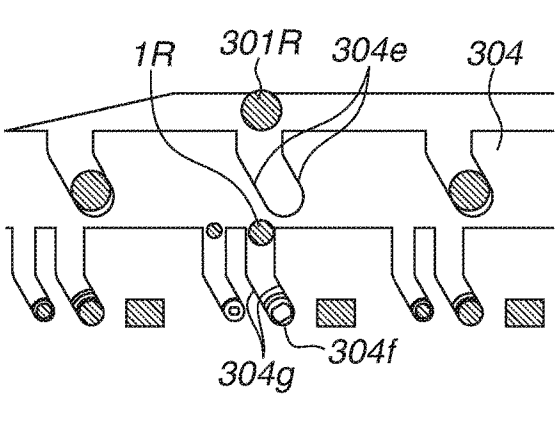
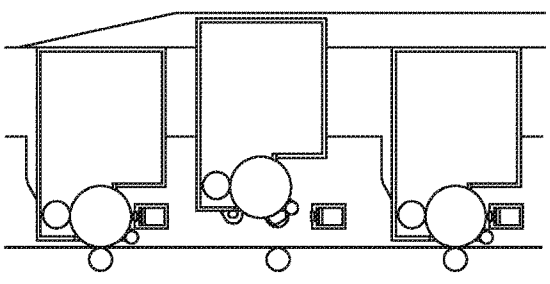
FIG.23B
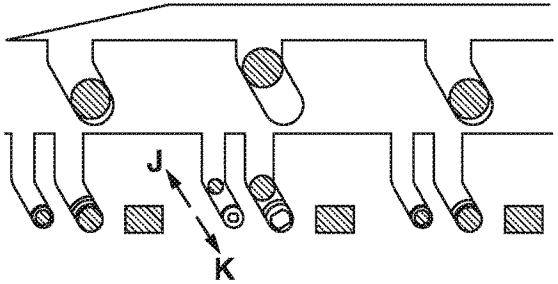
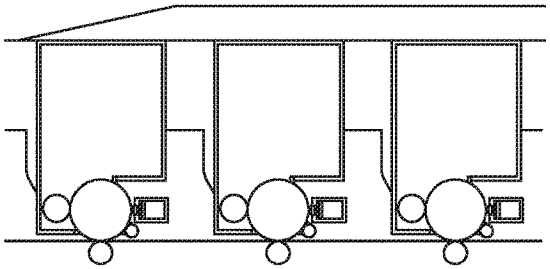
FIG.23C
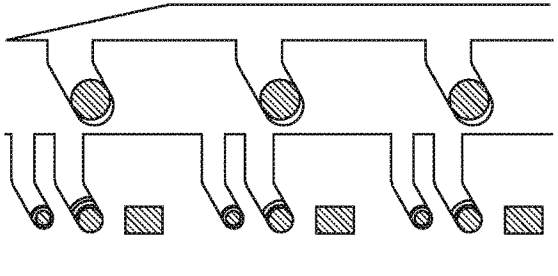

IMAGE FORMING APPARATUS

BACKGROUND OF THE INVENTION

Field of the Invention

The present disclosure relates to an image forming apparatus and is applicable to, for example, a laser beam printer, a facsimile machine, and a word processor employing the electrophotographic process.

Description of the Related Art

As a conventional configuration for exposing a photosensitive drum to light, a light emitting diode (LED) printer includes a plurality of LEDs (hereinafter referred to as an LED array) juxtaposed in the axial direction of a photosensitive drum, and digitally controls the exposure timing of each element to form a latent image on the drum. The LED array includes small LEDs as light emitting elements and therefore enables downsizing of an apparatus. The LED array has a high degree of freedom in the arrangement in an image forming apparatus. For this reason, there have been proposed various cartridge replacement methods which have been difficult in a conventional exposure apparatus having a large-sized scanner unit (light scanning apparatus unit).

For example, an image forming apparatus is proposed, with which a cartridge including a photosensitive drum is replaced by opening and closing the top cover of the apparatus main body (Japanese Patent Application Laid-Open No. 2008-296379). In this apparatus, a user replaces a cartridge by opening the top cover of the main body, vertically detaching the cartridge, and vertically attaching a new one. This process is intuitive, easy to understand, and has excellent usability.

Further, an image forming apparatus including a small-sized scanner (light scanning apparatus) is proposed, with which a cartridge including a photosensitive drum is replaced by opening and closing the top cover of the apparatus main body (Japanese Patent Application Laid-Open No. 2006-235656). Also in this apparatus, a user replaces a cartridge by opening the top cover of the main body, vertically detaching the cartridge, and vertically attaching a new one. This process is intuitive, easy to understand, and has excellent usability.

In the apparatus discussed in Japanese Patent Application Laid-Open No. 2008-296379, an LED array disposed at the top cover. Therefore, an opening/closing operation at the time of cartridge replacement moves the LED array to degrade the positional accuracy between the photosensitive drum and the LED array, making high precision printing difficult. Further, since the LED array is disposed at the top cover of the main body, the user can touch exposure surfaces of LEDs possibly causing an exposure failure. Since the LED array is disposed at the top cover, at the time of cartridge replacement, the LED array is moved by a large amount and a load on the user is accordingly increased.

SUMMARY OF THE INVENTION

The present disclosure is directed to further developing an image forming apparatus having a light emission unit including a plurality of light emitting elements.

According to an aspect of the present disclosure, an image forming apparatus includes an apparatus main body to which a cartridge including a photosensitive drum is detachably attached, a light emission unit disposed close to an image bearing member, provided with a plurality of light emitting elements arranged in a rotational shaft direction of the image bearing member, and configured to irradiate the photosensitive drum with light to form a latent image, a regulation member configured to, when inserting the cartridge into the apparatus main body, regulate a movement in a direction perpendicularly intersecting with an insertion direction of the cartridge until an insertion of the cartridge is completed, and a belt configured to come in contact with the photosensitive drum during image formation. The light emission unit is disposed upstream from the belt in the insertion direction. In a state where the insertion of the cartridge into the apparatus main body is completed, in a normal direction to the surface of the belt, a distance from a surface of the belt to a rotational shaft of the photosensitive drum is longer than a distance from the surface of the belt to an image forming position where light emitted by the light emission unit forms an image on a surface of the photosensitive drum.

Further features and aspects of the present disclosure will become apparent from the following description of various example embodiments with reference to the attached drawings.

BRIEF DESCRIPTION OF THE DRAWINGS

FIGS. 23A, 23B, and 23C are sectional views illustrating cartridge replacement in the image forming apparatus according to the second example embodiment.

DESCRIPTION OF THE EMBODIMENTS

Example embodiments of the present disclosure will be described in detail below with reference to the accompanying drawings.

(Image Forming Apparatus)

Figure 1:
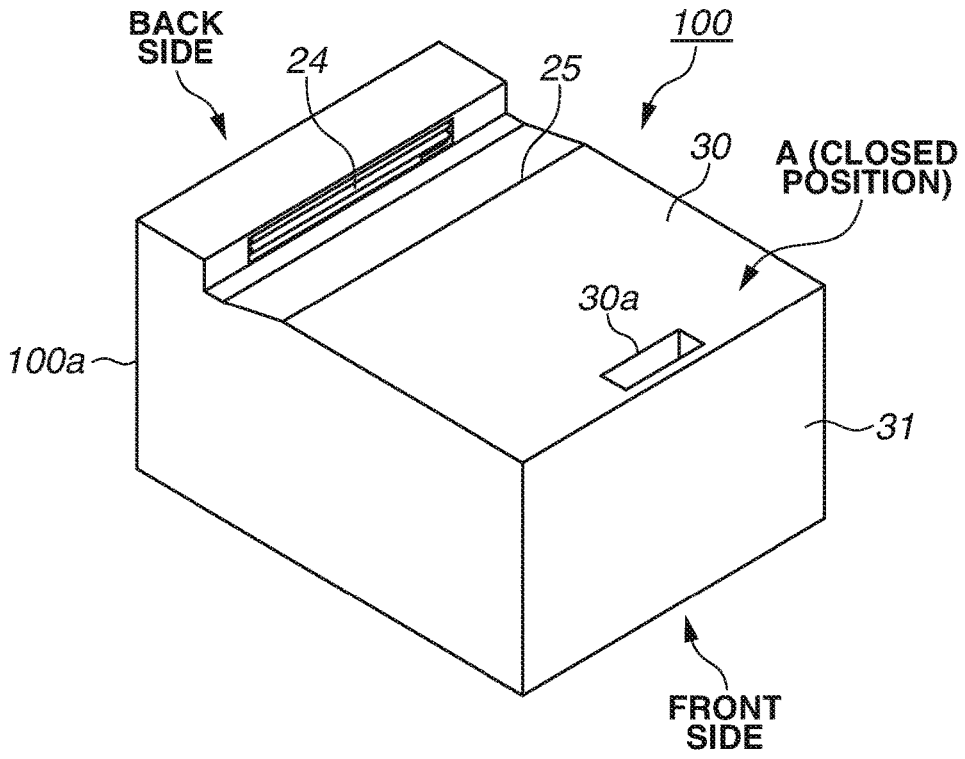
FIG. 1 is a perspective view illustrating an outer appearance an image forming apparatus according to a first example embodiment.
Figure 2:
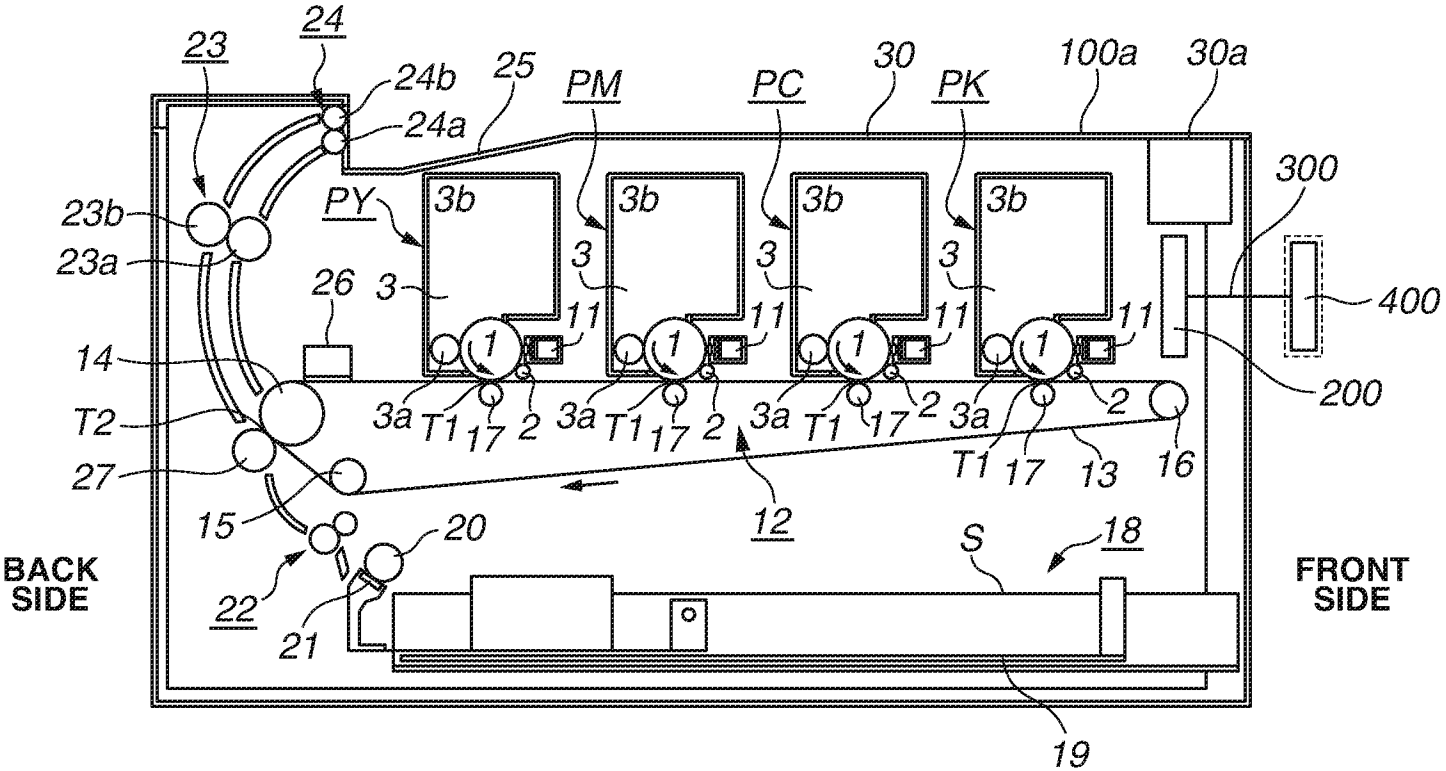
FIG. 2 is a sectional view illustrating the image forming apparatus according to the first example embodiment.

A first example embodiment will be described below. FIG. 1 is a perspective view illustrating an outer appearance of an image forming apparatus 100 according to the present example embodiment. FIG. 2 is a sectional view illustrating the image forming apparatus 100. The image forming apparatus 100 is a full color (4-color) LED printer using the electrophotographic process, having four cartridges P (PY, PM, PC, and PK) as a first to a fourth cartridge juxtaposed in a first direction. This image forming apparatus 100 capable of forming a full color (4-color) image or a monochrome image on a sheet-like recording medium (hereinafter referred to as a recording material) S based an electrical image signal output from an external host apparatus 400 (FIG. 2) and input to a control unit 200 via an interface unit 300.

The external host apparatus 400 is, for example, a personal computer, an image reader, or a facsimile machine as a communication partner.

The control unit 200 (FIG. 2) controls the electrophotographic image forming process of the image forming apparatus 100, and transmits and receives various types of electrical information to/from the external host apparatus 400. The control unit 200 performs processing on electrical information input from various types of process equipment and sensors, processing on instruction signals to various types of process equipment, predetermined initial sequence control, and sequence control for a predetermined electrophotographic image forming process.

In the following descriptions of the image forming apparatus 100, a side (front face side) refers to the side on which a surface 31 is disposed, and a back side (rear face side) refers to the side opposite to the surface 31. The anteroposterior direction refers to the direction from the back side toward the front side (anterior direction) of the image forming apparatus 100, and the direction (posterior direction) opposite to the anterior direction. The right and left sides refer to the right and left of the image forming apparatus 100, respectively, when viewed from the front side. The lateral direction refers to the direction from right to left (leftward direction), and the direction (rightward direction) opposite to the leftward direction. The top (top portion, upper portion, or upper side) and the bottom (bottom portion, lower portion, or lower side) refer to the top and bottom, respective in the vertical direction. The upward direction refers to the direction upwardly from the bottom, and a downward direction refers to the direction downwardly from the top.

The longitudinal direction refers to the direction parallel to the rotational axis direction (axial direction) of an electrophotographic photosensitive member as an image bearing member on which a latent image is to be formed. The widthwise direction refers to a direction (orthogonal direction) perpendicularly intersecting with the longitudinal direction. One side of the longitudinal direction is the drive side, and the other end side thereof non-drive side. According the present example embodiment, a right end side in the longitudinal direction is the drive side, and a left end side thereof is the non-drive side.

Within an image forming apparatus main body (hereinafter referred to as an apparatus main body) 100*a* of the image forming apparatus 100, the four cartridges PY, PM, PC, and PK as a first to a fourth cartridge are juxtaposed in the horizontal direction (first direction) from the back to the front side of the apparatus main body 100*a*, and attached at respective predetermined attachment positions. The image forming apparatus 100 employs what is called an in-line configuration or a tandem type configuration. The cartridges P are attached to positions at which the cartridges P can perform image forming operations, that is, positions at the time of image forming.

The cartridges P according to the present example embodiment are instrumental to the image forming process for forming an image on a recording material S as image forming units, and are detachably attached to the apparatus main body 100*a* of the image forming apparatus 100. Each cartridge P according to the present example embodiment includes a drum-shaped electrophotographic photosensitive member (hereinafter referred to as a drum or photosensitive drum) 1 as an image bearing member on which a latent image is to be formed. The cartridge P is what is called an integrated process cartridge including a development unit 3 (including a developer container) as an electrophotographic image forming process unit which acts on the drum 1. A charging device as a contact charging roller 2 is fixed to apparatus main body 100*a* according to the present example embodiment.

The development unit 3 is a contact type or noncontact type development unit including a developing roller 3*a* as a developer bearing member for supplying the developer to the drum 1 to develop a latent image as a developer image, and a developer storage unit 3*b* storing the developer. The color of the stored developer (hereinafter referred to as toner) differs for each cartridge P.

More specifically, the first cartridge PY including the development unit 3 storing yellow (Y) toner forms a Y color toner image on the surface of the drum 1. The second cartridge PM including the development unit 3 storing magenta (M) toner forms an M color toner image on surface of the drum 1. The third cartridge PC including the development unit 3 storing cyan (C) toner forms a C color toner image on the surface of the drum 1. The fourth cartridge PK including the development unit 3 storing black (K) toner forms a K color toner image on the surface of the drum 1.

Figure 3:
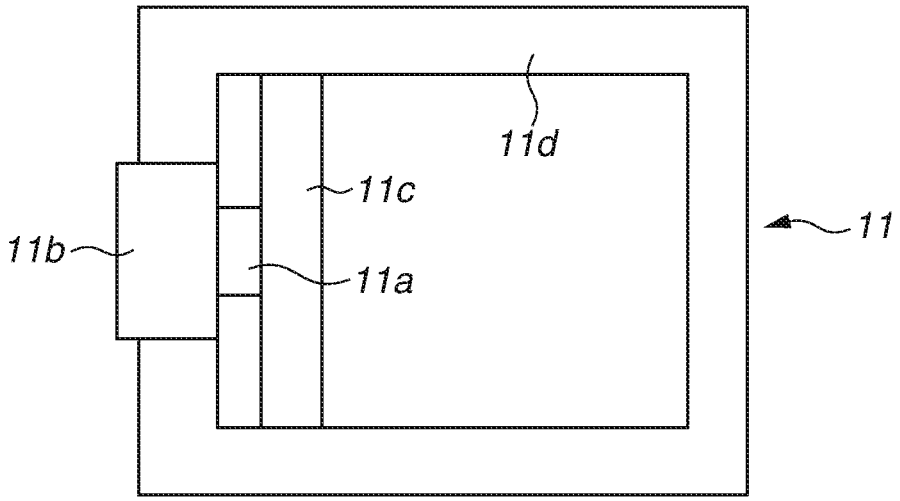
FIG. 3 is an enlarged sectional view illustrating an LED unit according to the first example embodiment.

On the front side of each of the cartridges PY, PM, PC, and PK (on the right-hand side of each cartridge P referring to FIG. 2), an LED unit 11 as a light emission unit (exposure unit) for forming a latent image by exposure on the drum 1 of each cartridge P is disposed close to the drum 1. FIG. 3 is an enlarged sectional view illustrating the LED unit 11. The LED unit 11 includes LED elements 11*a*, gradient index type lenses 11*b*, an electronic substrate 11*c*, and an LED unit housing 11*d*. A plurality of the LED elements 11*a* is disposed in the longitudinal direction, and a plurality of the lenses 11*b* is disposed corresponding to the LED elements 11*a*.

A plurality of the LED elements 11*a*, the lenses 11*b*, and the electronic substrate 11*c* are held by the LED unit housing 11*d*. An electrical conductive path is established between the electronic substrate 11*c* and the control unit 200. Operations for forming a latent image on the drum 1 are controlled by turning ON and OFF the light emission of each LED element 11*a* according to image information for each color input from the external host apparatus 400 to the control unit 200. Light of each LED element 11*a* is condensed on each drum 1 through the lens 11*b* to form a latent image.

A primary transfer roller 17 is disposed below each of the cartridges PY, PM, PC, and PK to face each cartridge P. The primary transfer roller 17 serves as transfer member for primarily transferring a toner image on the drum 1 to an intermediate transfer member (described below). According to the present example embodiment, the toner image primarily transferred to the intermediate transfer member is secondarily transferred to the recording material S by a secondary transfer roller 27.

An intermediate transfer unit 12 illustrated in FIG. 2 includes a dielectric flexible endless belt (an intermediate transfer belt or a belt) 13 as an intermediate transfer member (second image bearing member, i.e., intermediate recording medium). The intermediate transfer unit 12 further includes a drive roller 14, an auxiliary roller 15, and a tension roller 16 for circularly moving the belt 13 entrained therearound in a stretched way.

The drive roller 14 and the auxiliary roller 15 are disposed on the back side within the apparatus main body 100*a*. The tension roller 16 is disposed on the front side within the apparatus main body 100*a*. In a state where each cartridge P is attached at a predetermined attachment position, the undersurface of each drum 1 is in contact with the upper surface of the upper belt portion of the belt 13. Inside the belt 13, the primary transfer roller 17 is disposed to face the drum 1 of each cartridge across the upper belt portion.

In each cartridge P, a nip portion between the drum 1 and the belt 13 is a primary transfer nip portion T1. A secondary transfer roller 27 is in contact with the drive roller 14 across the belt 13. A nip portion between the secondary transfer roller 27 and the belt 13 is a secondary transfer nip portion T2.

A sheet feed unit 18 for storing the recording materials S to which a toner image transferred disposed below the intermediate transfer unit 12. The sheet feed unit 18 feeds the recording materials S one by one to the intermediate transfer unit 12. The sheet feed unit 18 includes a paper feed tray 19 for storing the stacked recording materials a feed roller 20, a separation pad 21, and a registration roller pair 22. The paper feed tray 19 can be freely loaded from the front side of the apparatus main body 100*a* (front loading).

At the upper portion on the back side within the apparatus main body 100*a*, there are disposed a fixing apparatus 23 as a fixing unit and roller pair 24 for discharging the recording material S. The fixing apparatus 23 applies heat and pressure to the recording material S which bears a toner image transferred thereto, to fix the toner image to the recording material S. According to the present example embodiment, the fixing apparatus 23 includes a fixing film assembly 23*a* and a pressure roller 23*b*, and the discharging roller pair 24 includes discharging rollers 24*a* and 24*b*.

A door 30 as an opening/closing member for an upper opening portion of the apparatus main body 100*a* is disposed at the upper portion of the apparatus main body 100*a*. The door 30 is rotatable around predetermined position as a fulcrum in the direction (first direction) in which a plurality of the cartridges P is juxtaposed. The user can detachably attach the cartridges to the apparatus main body 100*a* through the opening portion. According to the present example embodiment, a part of the upper surface of the door 30 functions as a discharge tray 25.

(Image Forming Operations)

Operations for forming a full color image will be described below. In each of the first to the fourth cartridges PY, PM, PC, and PK, the drum is driven to rotate at a predetermined control speed in the direction (counterclockwise direction) indicated by the arrow illustrated in FIG. 2. The belt 13 is also driven to rotate at a speed corresponding to the speed of the drum 1 in the clockwise direction indicated by the arrow (in a forward direction of the rotation of the drum 1).

In each cartridge P, the charging roller 2 uniformly charges the surface of the drum 1 to a predetermined polarity and potential at predetermined control timing, in synchronization with the driving. Then, the LED unit 11 irradiates the surface of the drum 1 with light for exposure, according to an image signal for each color. In this way, a static electricity latent image (latent image) according to the image signal of the corresponding color is formed on the surface of each drum 1. The formed latent image is developed as toner image (developer image) by the development unit 3.

A Y color toner image corresponding to the Y color component of a full color image is formed on the drum 1 of the first cartridge PY through the above-described electrophotographic image forming process operations. At the primary transfer nip portion T1 of the cartridge PY, the toner image primarily transferred to the belt 13. An M color image corresponding the M color component of the full color image is formed on the drum 1 of the second cartridge PM. At the primary transfer nip portion T1 of the cartridge PM, the toner image primarily transferred to the Y color toner image already transferred on the belt 13 in a superimposed way.

A C color toner image corresponding to the C color component of the full color image is formed on the drum 1 of third cartridge PC. At the primary transfer nip portion T1 of the cartridge PC, the toner image primarily transferred to the Y+M color toner image already transferred on the belt 13 in a superimposed way. A K color toner image corresponding to the K color component of the full color image is formed on the drum 1 of the fourth cartridge PK. At the primary transfer nip portion T1 of the cartridge PK, the toner image is primarily transferred to the Y+M+C color toner image already transferred on the belt 13 in a superimposed way.

As a result, 4-color (Y+M+C+K) superimposed toner image (color image) is formed on the belt 13 in an unfixed state.

Meanwhile, the feed roller 20 is driven at predetermined control timing. In this way, the feed roller 20 and the separation pad 21 collaborate to separate and feed one sheet of the recording materials S stacked in the paper feed tray 19. Then, the registration roller pair 22 guides the recording material to the secondary transfer nip portion T2 at predetermined control timing. In this way, in a process in which the recording material S is conveyed through the secondary transfer nip portion T2 in a nipped state, the 4-color superimposed toner image on the belt 13 is collectively transferred to the surface of the recording material S.

Then, the recording material S is separated from the surface of the belt 13, guided to the fixing apparatus 23 through the conveyance path, and applied with heat and pressure at the fixing nip portion N. In this way, toner images of respective colors are mixed and fixed to the recording material S. After that, the recording material S exits the fixing apparatus 23 and is discharged onto the discharge tray 25 as a full color image by the discharging roller pair 24. After the recording material P is separated from the belt 13, secondary transfer residual toner remaining on the surface of the belt 13 is removed by a cleaning unit 26.

(Positioning of Image Forming Process Parts)

Figure 4A:
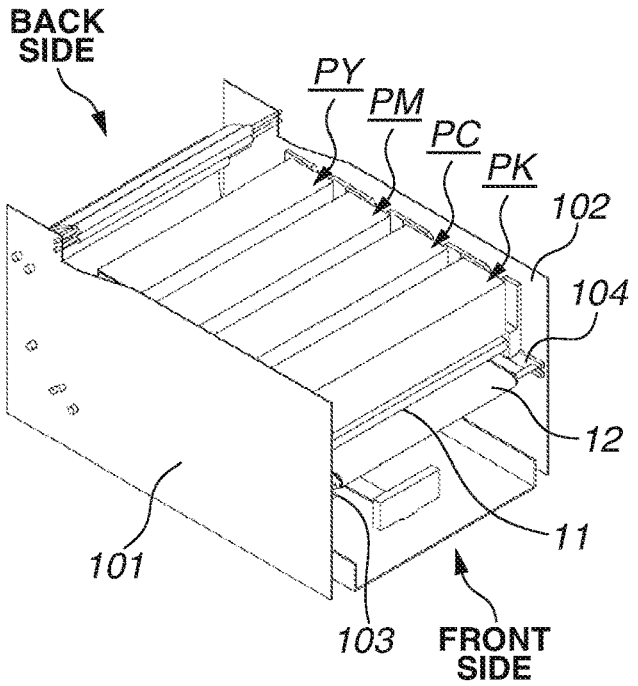
FIGS. 4A and 4B are perspective views illustrating the main body of the image forming apparatus according to the first example embodiment.
Figure 4B:
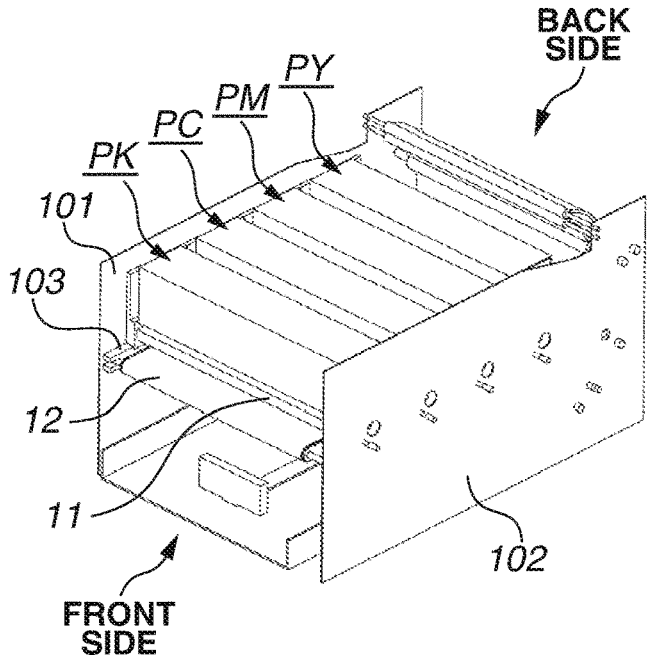

The following describes positioning of the cartridges P, the LED units 11, the charging rollers 2, and the intermediate transfer unit 12 as image forming process parts relative to the apparatus main body 100*a*. FIGS. 4A and 4B illustrate the apparatus main body 100*a* when viewed from the left-hand side and the right-hand side, respectively (the exterior and drive system are not illustrated). The apparatus main body 100*a* is provided with a left substrate 101 (FIG. 4A) and a right substrate 102 (FIG. 4B) for supporting each roller and each unit.

The left substrate 101 is provided with a left holder 103, and the right substrate 102 is provided with a right holder 104. The right and the left holders 103 and 104 are integrally formed. The left and the right holders 103 and 104 support the cartridges P, the LED units 11, the charging rollers 2, and the intermediate transfer unit 12 as identical holding members, and determine the positions of these members relative to the apparatus main body and each unit.

Figure 5A:
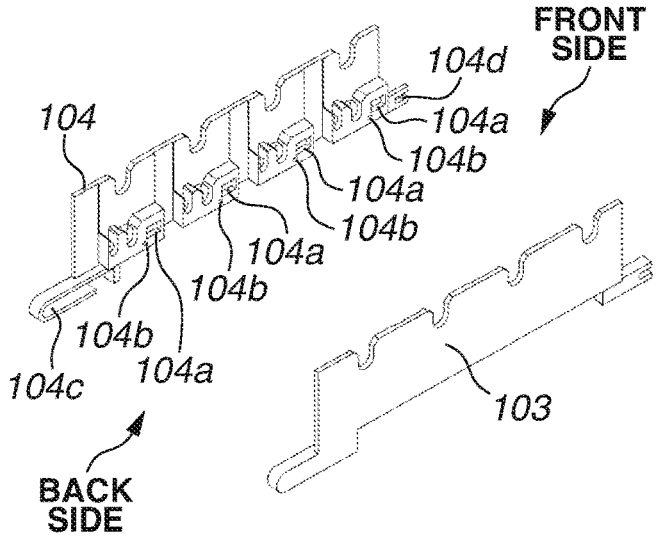
FIGS. 5A, 5B, and 5C are perspective views illustrating image forming process parts of the image forming apparatus according to the first example embodiment.
Figure 5B:
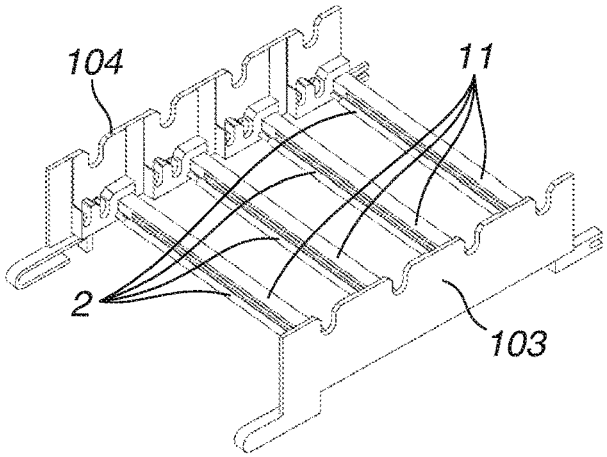
Figure 5C:
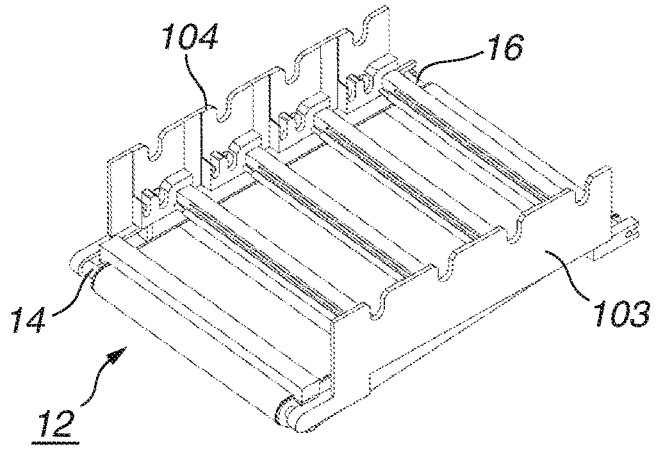

FIG. 5A illustrates only the left and the right holders 103 and 104, FIG. 5B illustrates a state where the LED units 11 and the charging rollers 2 are additionally disposed in the state illustrated in FIG. 5A, and FIG. 5C illustrates a state where the intermediate transfer unit 12 is additionally disposed in the state illustrated in FIG. 5B. The LED units 11 are fixed to the holes 104*a* of the right holder 104 corresponding to the four cartridges PY, PM, PC, and PK.

The charging rollers 2 are rotatably supported by the holes 104*b* of the right holder 104. The left holder 103 is also provided with hole shapes (not illustrated) similar to those of the right holder 104. These shapes also fix the LED units 11 and rotatably support the charging rollers 2.

In the intermediate transfer unit 12, the drive roller 14 and the tension roller 16 are rotatably supported by the holes 104*c* and 104*d* (FIG. 5A) on the right holder 104, respectively. Similar to the LED units 11 and the charging rollers 2, the drive roller 14 and the tension roller 16 are also supported by the left holder 103.

Figure 6A:
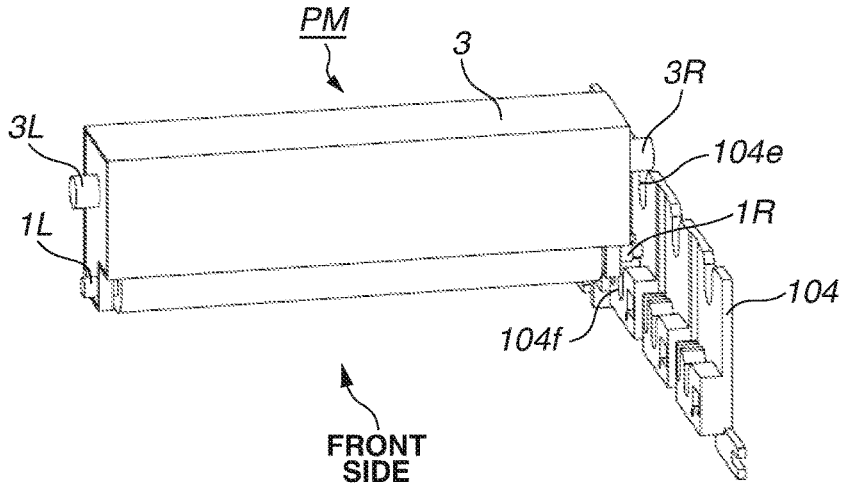
FIGS. 6A and 6B illustrate a pre-attachment state of a cartridge PM in the image forming apparatus according to the first example embodiment.
Figure 6B:
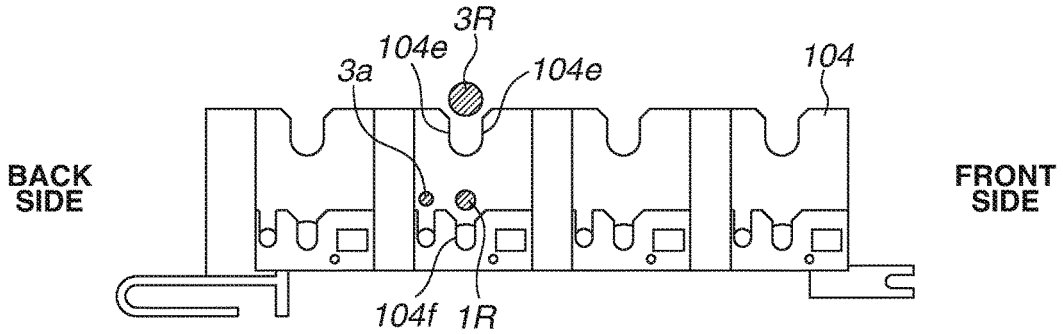
Figure 7A:
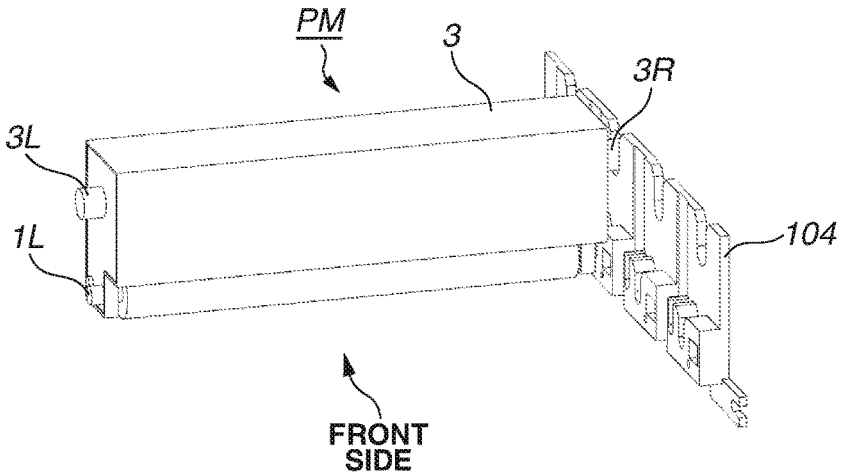
FIGS. 7A and 7B illustrate a state of an attachment position of the cartridge PM in the image forming apparatus according to the first example embodiment.
Figure 7B:
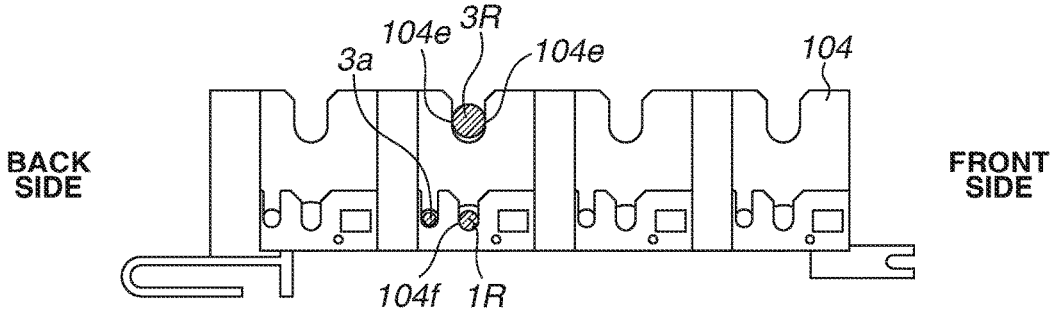

A method for supporting the cartridges P will be described below. FIGS. 6A and 6B illustrate a state before only a cartridge PM is attached to the right holder 104, and FIGS. 7A to 7C illustrate a state after the cartridge PM has been attached to the right holder 104. FIGS. 6A and 7A are perspective views illustrating the cartridge PM and the right holder 104, and FIGS. 6B and 7B are sectional views illustrating the cartridge PM and the right holder 104 illustrated in FIGS. 6A and 7A, respectively.

A method for holding a cartridge P will be described below by using only the cartridge PM and the right holder 104. Similar to the LED units 11, the charging rollers 2, and the intermediate transfer unit 12, the cartridge PM and the right holder 104 are also supported by the left holder 103. The cartridges PY, PC, and PK are supported in a similar way to the cartridge PM.

As illustrated in FIG. 6B, the right holder 104 is provided with U-shaped slots for positioning and inserting/extracting (attaching/detaching) a cartridge P. These slots respectively correspond to a drum shaft 1R of the drum 1 held by the cartridge PM and a boss 3R of the development unit 3 of the cartridge PM. Two U-shaped slots for positioning and inserting/extracting (attaching/detaching) a cartridge P are provided for each color. Referring to FIG. 6B, the right holder 104 is also provided with another U-shaped slot for placing the shaft of the developing roller 3*a*. This U-shaped slot is not used for positioning but for connecting to and disconnecting from the drive system (described below).

Referring to FIG. 7B, the drum shaft 1R of the drum 1 held by the cartridge PM is rotatably supported by a curved surface portion 104*f* of the U-shaped slot of the right holder 104, thus determining the position of the drum 1. A U-shaped slot as an attachment/detachment passage is formed on the right holder 104 as an attachment/detachment passage forming member. The boss 3R of the development unit 3 of the cartridge PM fits into regulation portions 104*e* as straight portions of the U-shaped slot of the right holder 104, thus regulating the rotation of the center of the drum 1 in the cartridge PM. The above-described configuration determines the position of the cartridge PM relative to the apparatus main body 100*a*.

As described above, the positions of the cartridges P, the LED units 11, the charging rollers 2, and the intermediate transfer unit 12 are determined only by the left and the right holders 103 and 104. Thus, high precision positioning is achieved because the members for holding positioning parts for the cartridges P, the LED units 11, the charging rollers 2, and the intermediate transfer unit 12 related to the image forming process are common (same).

Further, the LED units 11 do not move as in the apparatus discussed in the Japanese Patent Application Laid-Open No. 2008-296379. Therefore, there arises no positional accuracy degradation due to parts abrasion during movement, thus enabling high precision printing. Since the LED units 11 are not installed on a cover to opened to replace a cartridge as in the apparatus discussed in the Japanese Patent Application Laid-Open No. 2008-296379 but installed inside the apparatus main body 100*a*, the user can hardly touch the exposure surfaces of the LED units 11 and there is no possibility of poor exposure.

(Necessity of Cartridge Replacement and Replacement Operations)

In the first to the fourth cartridges PY, PM, PC, and PK, a developer stored in the development unit 3 is consumed as the developer is used for image formation. The apparatus main body 100*a* is provided with a method (not illustrated) for detecting the amount of remaining developer for each cartridge.

The control unit 200 compares the detected value with a preset threshold value for life notification or warning. When the detected value of the developer remaining amount is smaller than the threshold value for a certain cartridge, the control unit 200 displays the life notification or warning for the cartridge on a display unit (not illustrated). This prompts a user to ready a new cartridge in preparation for replacement or replace the cartridge to maintain the quality of output images.

Figure 8A:
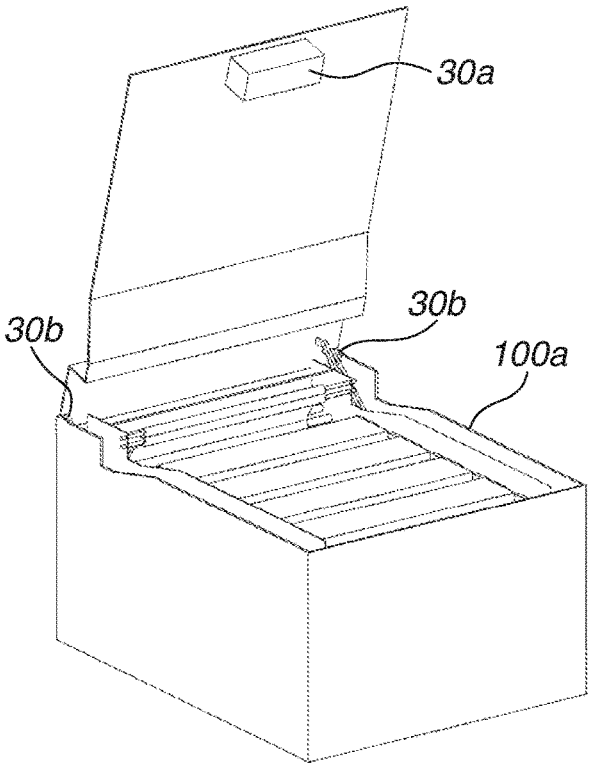
FIGS. 8A and 8B illustrate a door open state of the image forming apparatus according to the first example embodiment.
Figure 8B:
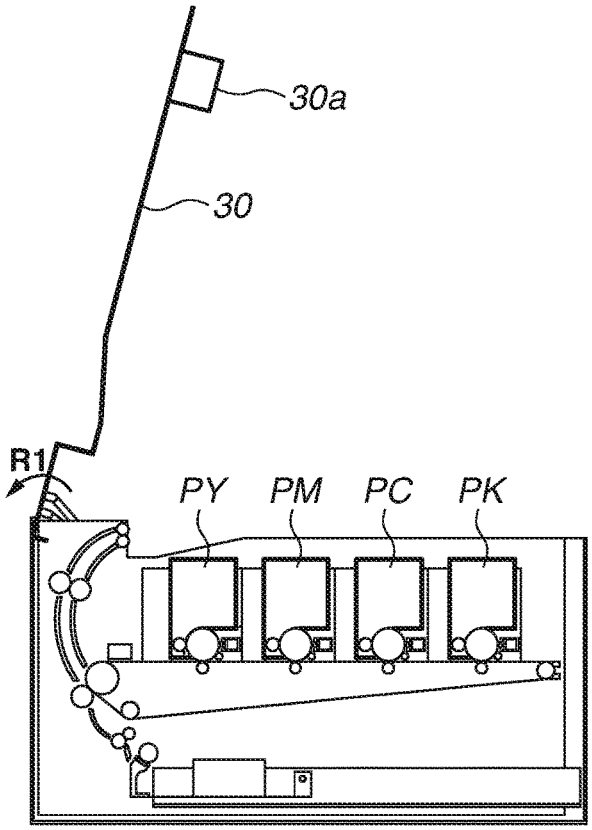
Figure 9A:
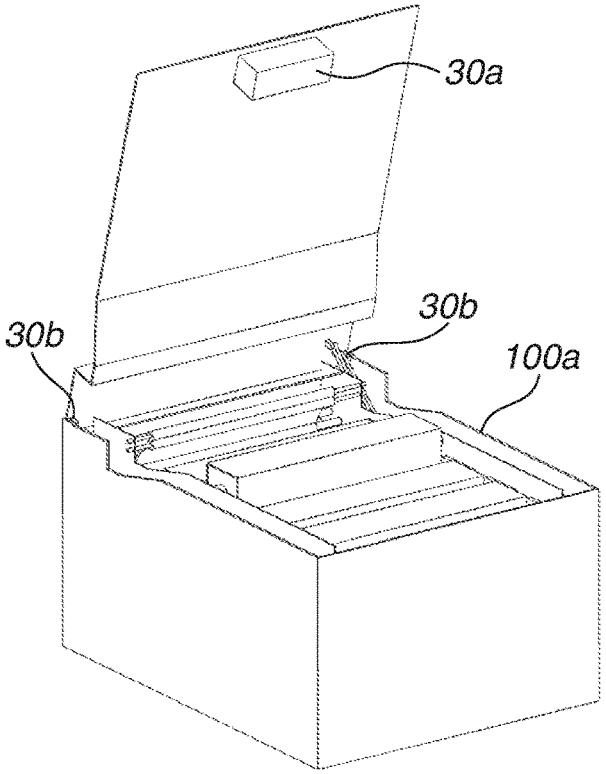
FIGS. 9A and 9B illustrate a pull-out state of a cartridge PM in the image forming apparatus according to the first example embodiment.
Figure 9B:
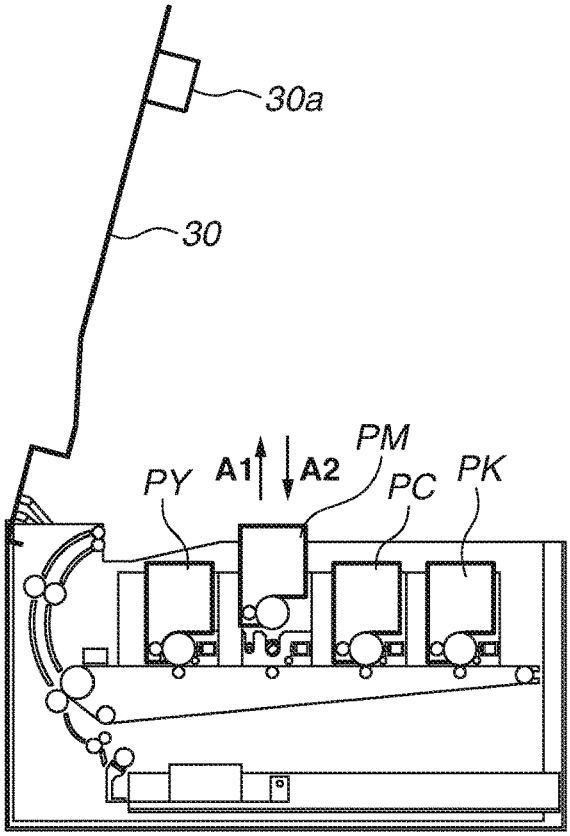

Cartridge replacement operations described below. FIG. 8A illustrates a state where the door 30 is opened, and FIG. 8B is a sectional view the state illustrated in FIG. 8A. FIG. 9A illustrates a state where a cartridge PM is slightly pulled out in the state illustrated in FIG. 8A, and FIG. 9B is a sectional view illustrating the state illustrated in FIG. 9A. When replacing the cartridge PM of the image forming apparatus 100 according to the present example embodiment, the user holds a handle 30*a* and rotates the door 30 in the R1 direction around a door rotational axis 30*b* to open the door 30, as illustrated in FIGS. 8A and 8B.

Then, as illustrated in FIGS. 9A and 9B, the user pulls the cartridge PM in the A1 direction to take it out from the inside of the apparatus main body 100*a* and inserts new cartridge PM in the A2 direction to replace the cartridge. When the user opens the door 30, the drive of the drum 1 and the developing roller 3*a* is disconnected in synchronization with the opening. When the user closes the door 30, the drive is accordingly connected. When the user opens the door 30 and the drive of the drum 1 and the developing roller 3*a* is disconnected, the cartridge PM can be easily detached from the apparatus main body 100*a*.

Figure 10:
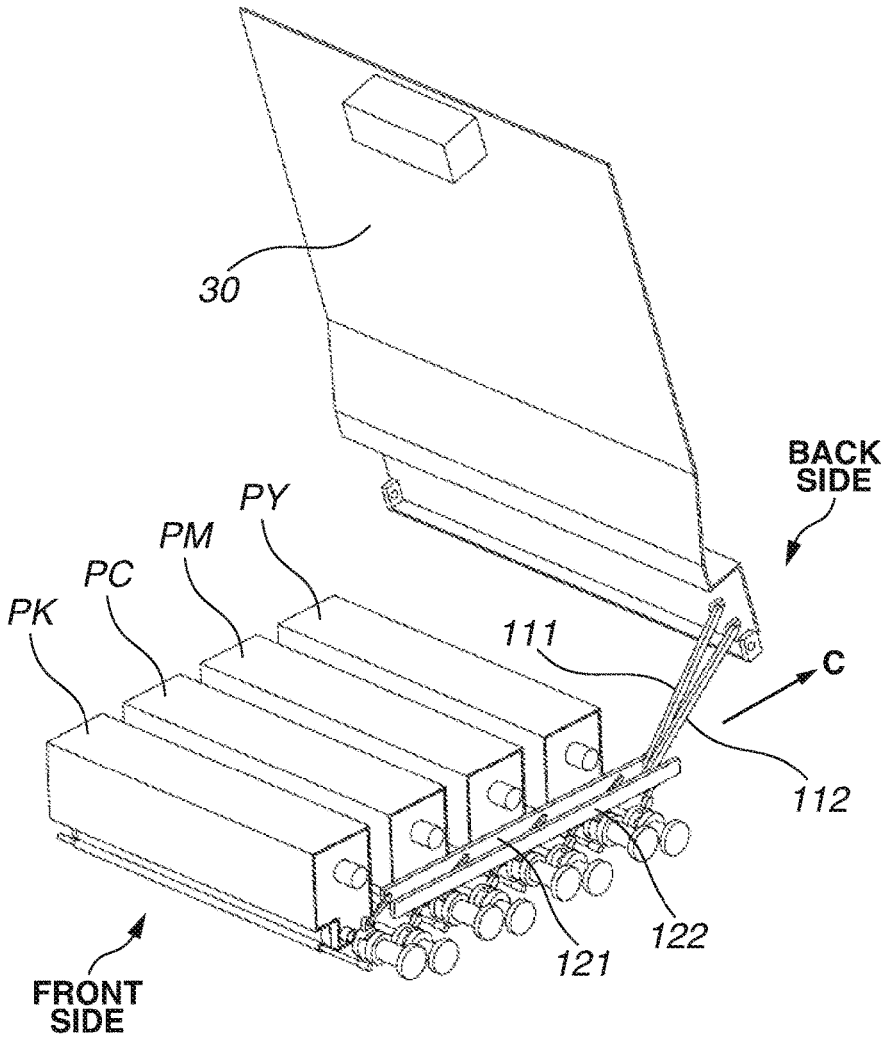
FIG. 10 illustrates a door open state (around a drive system) in the image forming apparatus according to the first example embodiment.
Figure 11A:
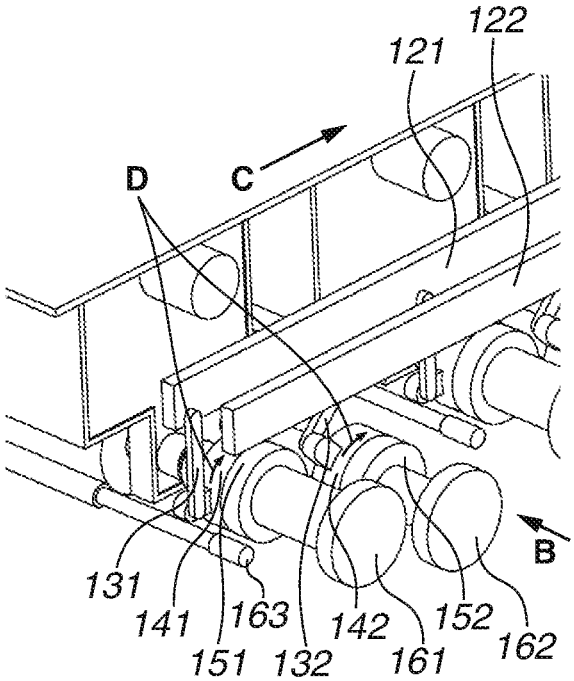
FIGS. 11A and 11B are enlarged views illustrating a cartridge drive system of the image forming apparatus according to the first example embodiment.
Figure 11B:
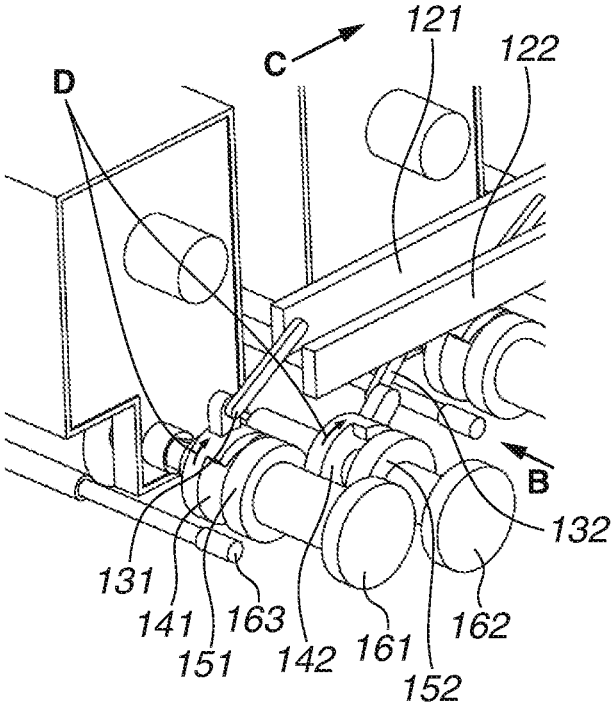
Figure 12A:
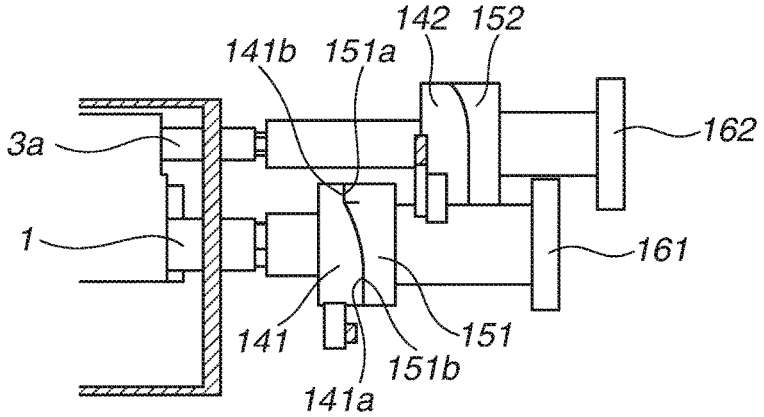
FIGS. 12A and 12B are enlarged sectional views illustrating cartridge drive system of the image forming apparatus according to the first example embodiment.
Figure 12B:
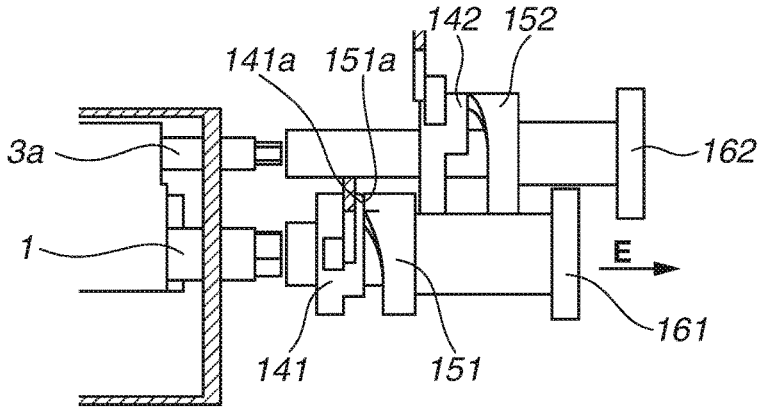

The following describes configurations for opening and closing the door 30 and for connecting and disconnecting the drive of the drum 1 and the developing roller 3*a*. FIG. 10 illustrates only the door 30 when opened, the cartridges P, and drive systems around the cartridges P. FIGS. 11A and 11B are enlarged views illustrating the drive system around the cartridge PK, and FIGS. 12A and 12B are sectional views illustrating the drive system illustrated FIGS. 11A and 11B. FIGS. 11A and 12A illustrate a state where the door 30 is closed, and FIGS. 11B and 12B illustrate a state where the door 30 is opened.

As illustrated in FIG. 10, at the door 30, link arms 111 and 112 are rotatably supported and are connected to links 121 and 122, respectively. The links 121 and 122 are supported movably only in the longitudinal direction of the main body 100*a* (a supporting method is not illustrated).

Since a method for connecting and disconnecting the drive is common to the cartridges PY, PM, PC, and PK, description will be given below about the cartridge PK as a representative. As illustrated in FIG. 11A and FIG. 11B, the links 121 and 122 are connected to link arms 131 and 132, respectively. The link arms 131 and 132 are rotatably supported by coupling cams 141 and 142, respectively.

The coupling cams 141 and 142 contact coupling cams 151 and 152, respectively. Drive gears 161 and 162 are rotatably disposed at the center of the coupling cams 141 and 151 and the center of the coupling cams 142 and 152, respectively. The drive gear 161 drives the drum 1, the drive gear 162 drives the developing roller 3*a*, and a drive gear 163 drives the charging roller 2 (a method for supporting drive gears is not illustrated). The drive gears 161 and 162 are pressed in the B direction by springs (not illustrated), and the urging forces thereof can also be transmitted to the coupling cams 151 and 152, respectively.

When the door 30 is opened in this state, the state illustrated in FIG. 11A shifts to the state illustrated in FIG. 11B. At this timing, the links 121 and 122 move in the C direction, and accordingly the coupling cams 141 and 142 connected with the link arms 131 and 132 rotate in the D direction. Where the door 30 is closed, as illustrated in FIG. 12A, the coupling cams 141 and 151 on the side of the drum 1 are in a state where a cam surface 141*a* contacts a cam surface 151*b*, and a cam surface 141*b* contacts a cam surface 151*a*.

On the other hand, when the door 30 is opened, as illustrated in FIG. 12B, the coupling cams 141 and 151 are in a state where the cam surface 141*a* contacts the cam surface 151*a*. At this timing, the coupling cam 151 and the drive gear 161 move in the E direction (the direction opposite to the B direction) against the urging force of a spring (not illustrated), disconnecting the connection between the drum 1 and the drive gear 161. This prevents the driving force from transmitting to the drum 1.

The coupling cams 142 and 152 on the side of the developing roller 3*a* are configured in a similar way to the side of the drum 1, and redundant descriptions thereof will be omitted. When the door 30 is opened, the driving force is not transmitted to the developing roller 3*a*.

As described above, when the door 30 is opened, the driving force to the drum 1 and the developing roller 3*a* can be disconnected, allowing the user to replace a cartridge P.

Figure 13A:
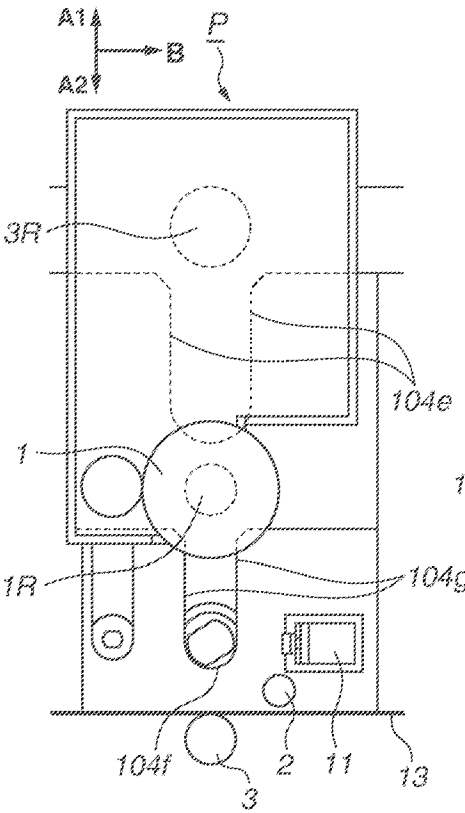
FIGS. 13A, 13B, 13C and 13D are enlarged sectional views illustrating cartridge replacement in the image forming apparatus according to the first example embodiment.
Figure 13B:
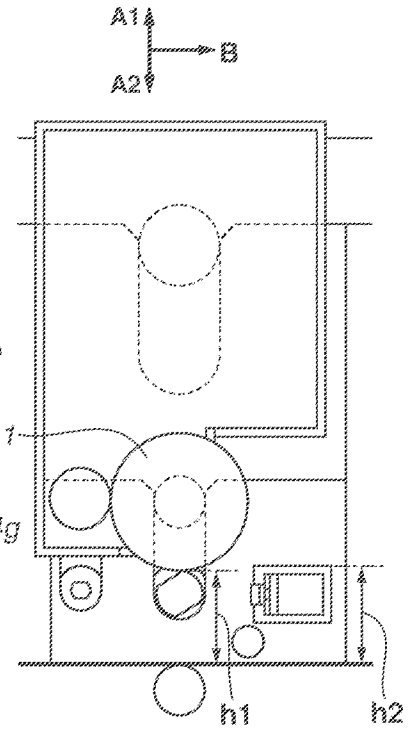
Figure 13C:
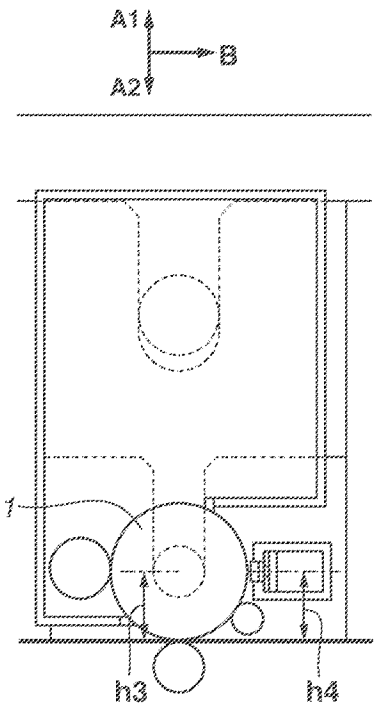
Figure 13D:
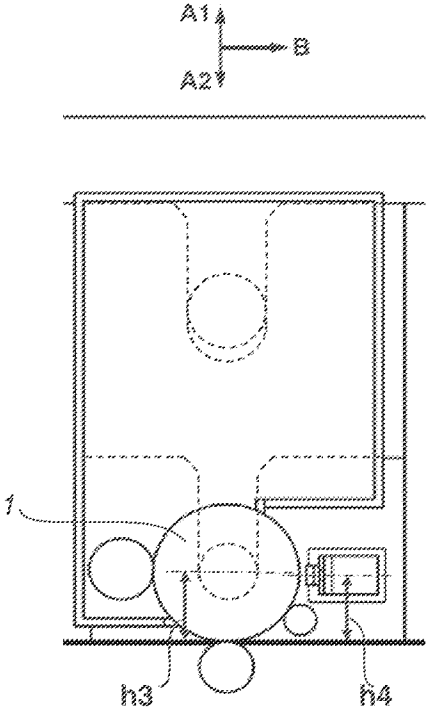

Lastly, a relation between the attachment/detachment of a cartridge P and the LED units 11 fixed to the apparatus main body 100*a* will be described below. FIGS. 13A to 13C are enlarged sectional views illustrating a state where a cartridge P is replaced. While FIGS. 13A to 13C illustrate a relation between cartridge P and the right holder 104, the left holder 103 has a similar configuration. FIG. 13A illustrates a state before a cartridge P is attached to the attachment position, FIG. 13E illustrates a state where the cartridge P is regulated to move only in two directions by the regulation portions 104*e* and 104*g*, and FIG. 13C illustrates a state where the cartridge P has been attached to the attachment position.

As the cartridge P is inserted into the apparatus main body 100*a*, the boss 3R of the cartridge P and the drum shaft 1R come in contact with the regulation portions 104*e* and 104*g* of the right holder 104, respectively (the state illustrated in FIG. 13B). When the cartridge P is inserted further, the cartridge P becomes movable only in the vertical direction illustrated in FIG. 13C.

At this timing, a relation "h1>h2" is satisfied, where h1 denotes the height from the belt 13 (FIG. 2) to the drum 1, and h2 denotes the height from the belt 13 to the LED unit 11. Therefore, when h1≤h2, the movement of the cartridge P in the B direction perpendicularly intersecting with the extraction direction A1 and the insertion direction A2 is regulated by the regulation portions 104*e* and 104*g* until the insertion of the cartridge P is completed. Thus, the drum 1 can be prevented from contacting the LED unit 11, so that the surface of the drum 1 can be prevented from being damaged, and the LED unit 11 can be prevented from breaking down. The LED unit 11 is disposed at a position where the LED unit 11 does not overlap with the attachment/detachment locus of the drum 1 in the B direction perpendicularly intersecting with the extraction direction A1 and the insertion direction A2 of the cartridge P. More specifically, in a state where the insertion of the cartridge P into the apparatus main body 100*a* is completed, the rotational shaft of the drum 1 is disposed, in the insertion direction A2 of the cartridge P, upstream from the image forming position where light emitted by the LED unit 11 forms an image on the surface of the drum 1. For this reason, even if the LED unit 11 is disposed, in the insertion direction A2, upstream from the belt 13, it becomes possible to prevent the drum 1 from contacting the LED unit 11, prevent the surface of the drum 1 from being damaged, and prevent the LED unit 11 from breaking down. The LED unit 11 is disposed at a position where the LED unit 11 does not overlap with the attachment/detachment locus of the drum 1 in the B direction. Therefore, a condition "h3≥h4" is satisfied in a state where the attachment of the cartridge P is completed, as illustrated in FIG. 13C, where h3 denotes the height of the rotational shaft of the drum 1 from the belt 13, and h4 denotes the height of the image forming position (where light from the LED unit 11 forms an image on the drum 1) from the belt 13. The height refers to the distance from the surface of the belt 13 to the rotational shaft or the image forming position of the drum 1 in the normal direction on the surface of the belt 13.

This configuration can be applied to positioning in which the LED unit 11 is abutted against and brought into contact with the drum 1 by using a spring (not illustrated). Even in such a configuration, the following effects are obtained: When the rotational shaft of the drum 1 is disposed, in the insertion direction A2 of the cartridge P (a direction from the surface of the belt 13 toward the drum 1 in the normal direction of the belt 13), at the same position as or upstream from the image forming position where light emitted by the LED unit 11 forms an image on the surface of the drum 1, the LED unit 11 does not contact the portion of the drum 1 having the largest radius at the time of inserting or extracting a cartridge P. Therefore, when a cartridge P is inserted or extracted, it is possible to reduce a time period during which the urging force of the spring (not illustrated) serves as a resistance to the attachment and detachment of a cartridge P, or the distance of the cartridge P. The fact that the LED unit 11 does not contact the portion of the drum 1 having the largest radius means that it is possible to reduce the distance over which the LED unit 11 is moved against the urging force of the spring (not illustrated) when inserting or extracting a cartridge P. Accordingly, when inserting or extracting a cartridge P, it is possible to reduce the maximum value of the resistance exerted on the cartridge P by the spring (not illustrated).

Further, regulating the cartridge P to a certain extent improves usability. When the user starts the insertion of the cartridge P into the apparatus main body 100*a* (the state illustrated in FIG. 13A), the user can insert the cartridge P while freely moving it. Then, after the user has inserted the cartridge P into the apparatus main body 100*a* to certain extent, the position of the cartridge P can be guided to the attachment position (the state illustrated in FIG. 13B).

The cartridge P is stopped at the attachment position where an image is formed on the drum (the state illustrated in 13C). Therefore, according to the present example embodiment, it is possible to achieve high usability and a configuration for inserting/extracting (attaching/detaching) a cartridge P without causing a damage to the cartridge P and the LED unit 11 when inserting a cartridge P.

According to the present example embodiment, as described above, it is possible to pro de an image forming apparatus capable of achieving both apparatus downsizing and high precision printing by using a light emission unit having a plurality of light emitting elements in a case where an opening/closing member is disposed at an upper portion of the apparatus in a vertical direction. More specifically, compared with a case where a light scanning apparatus (scanner) is used, the present example embodiment enables the apparatus downsizing by disposing an LED array as a light emission unit close to the photosensitive drum 1. This because the LED array produces a lower light quantity than a scanner, and a gradient index type lens for collecting LED light has a short focal length. In addition, high precision printing can be achieved by fixing the light emission unit to the inside of the apparatus main body 100*a*, unlike the apparatus discussed in Japanese Patent Application Laid-Open No. 2008-296379.

Further, high precision printing can be guaranteed by such positioning that the cartridge P does not hit the light emission unit fixed to the apparatus main body 100*a* when attaching/detaching a cartridge P including the drum 1.

A second example embodiment of the present disclosure will be described below with reference to FIGS. 19 to 23A to 23C. According to the first example embodiment, the cartridge (first cartridge) including the drum 1 does not include the charging roller 2. According to the present example embodiment, the cartridge (first cartridge) including the drum 1 includes the charging roller 2. Other configurations are similar to those according to the first example embodiment.

(Overall Schematic Configuration of Image Forming Apparatus)

Figure 19:
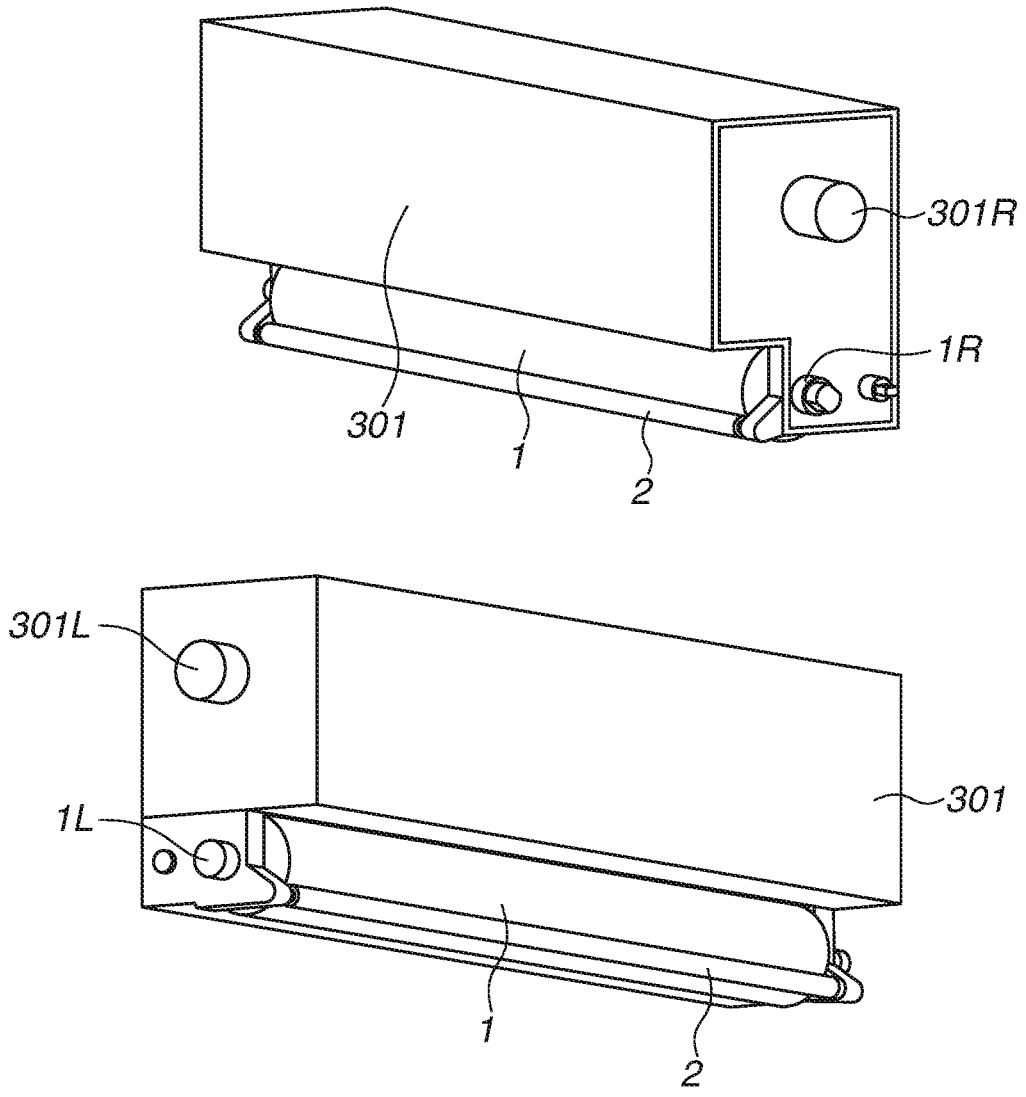
FIG. 19 is a perspective view illustrating a cartridge of an image forming apparatus according to a second example embodiment.

FIG. 19 is a perspective view illustrating a cartridge P having a configuration according to the present example embodiment. Similar to the first example embodiment, the cartridge P is provided with the drum 1 and the developing roller 3*a*. The cartridge P is also provided with the charging roller 2 as an additional member. More specifically, the charging roller 2 is rotatably supported in a development unit 301 including the developing roller 3*a*, and is rotatably driven along with the rotation of the drum 1.

(Positioning of Image Forming Process Parts)

Figure 20A:
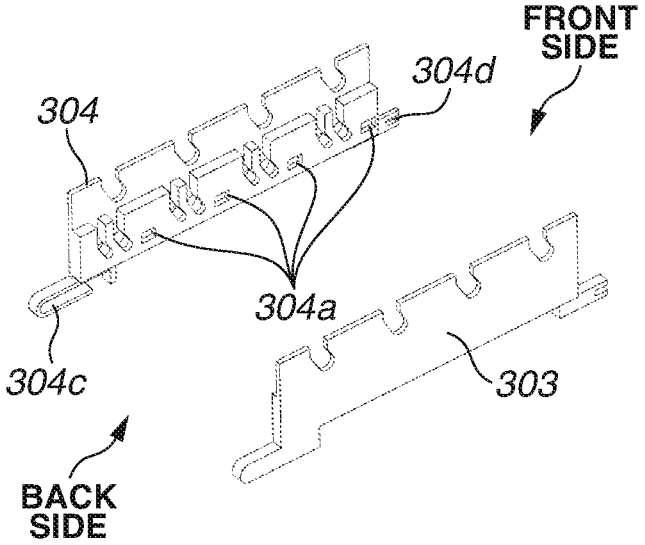
FIGS. 20A, 20B, and 20C are perspective views illustrating image forming process parts of the image forming apparatus according to the second example embodiment.
Figure 20B:
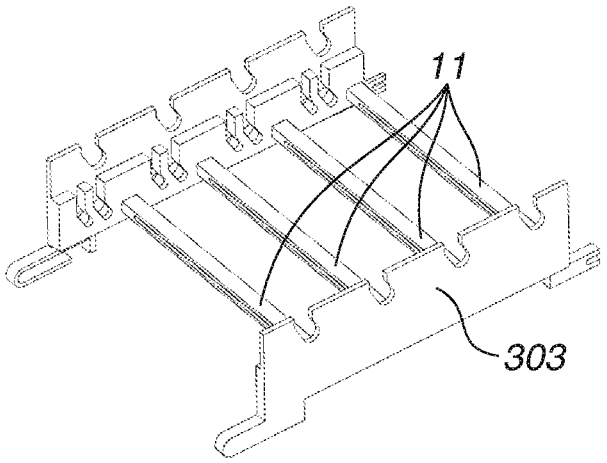
Figure 20C:
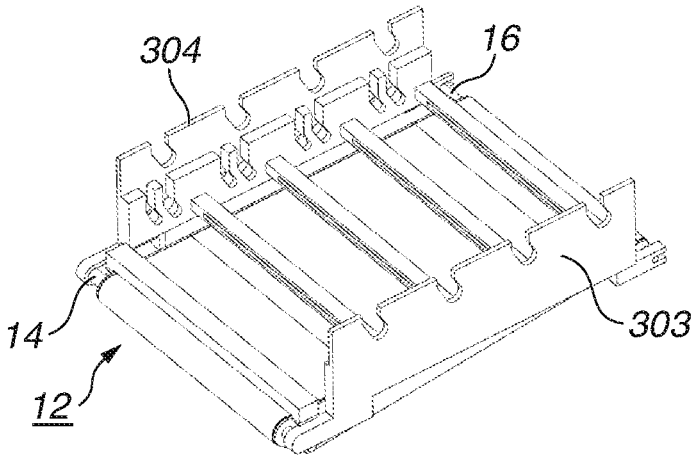

A method for positioning the cartridges P, the LED units 11, and the intermediate transfer unit 12 as image forming process parts relative to the apparatus main body 100*a* will be described below. FIG. 20A illustrates only left and the right holders 303 and 304, FIG. 20B illustrates a state where the LED units 11 are disposed in addition FIG. 20A, and FIG. 20C illustrates a state where the intermediate transfer unit 12 is disposed in addition to FIG. 20B. Similar to the first example embodiment, the left and the right holders 303 and 304 are disposed on the left and the right substrates 101 and 102, respectively.

The LED units 1 are fixed to the holes 304*a* of the right holder 304 corresponding to the four cartridges PY, PM, PC, and PK. Similar to the right holder 304, the left holder 303 is also provided with hole shapes (not illustrated), and the LED units 11 are fixed to the left holder 303.

In the intermediate transfer unit 12, the drive roller 14 and the tension roller 16 are rotatably supported in the holes 304*c* and 304*d* of the right holder 304. Similar to the LED units 11, the drive roller 14 and the tension roller 16 are also supported in the left holder 303.

Figure 21A:
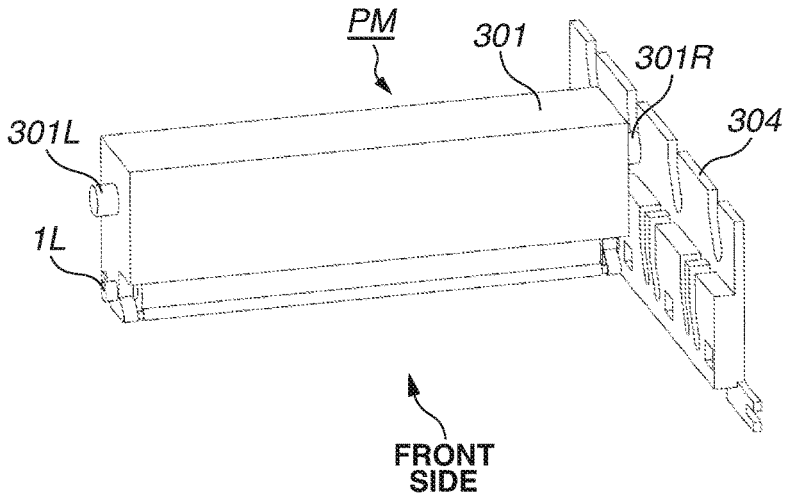
FIGS. 21A and 21B illustrate a state of an attachment position of a cartridge PM in the image forming apparatus according to the second example embodiment.
Figure 21B:
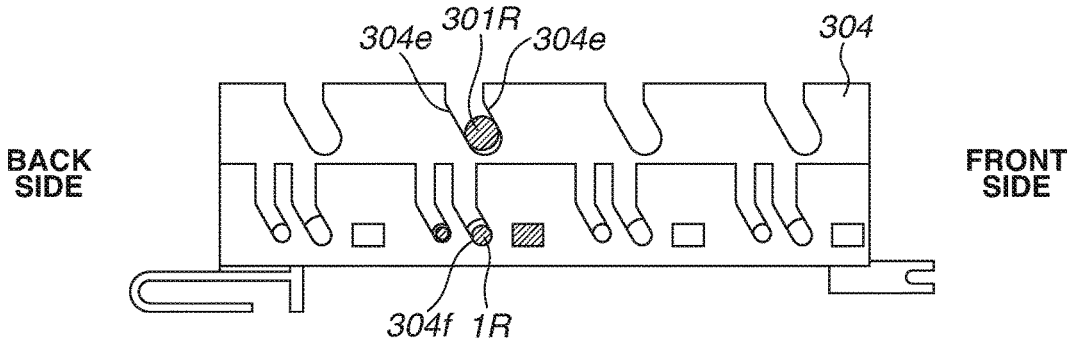

A method for supporting a cartridge P will be described below. FIGS. 21A and 12B illustrate a state where only a cartridge PM is attached to the right holder 304. FIG. 21A is a perspective view illustrating the cartridge PM and the right holder 304, and FIG. 21B is a sectional view illustrating the cartridge PM and the right holder 304 illustrated in FIG. 21A. The method for supporting the cartridge P will be described below based only on the cartridge PM and the right holder 304. However, same as the LED units 11 and the intermediate transfer unit 12, the cartridge PM is similarly supported in the left holder 303. The cartridges PY, PC, and PK are supported in a way similar to the cartridge PM.

The right holder 304 is provided with U-shaped slots for positioning and attaching/detaching a cartridge P corresponding to the drum shaft 1R of the drum 1 held in the cartridge PM and a boss 301R of the development unit 301 of the cartridge PM. Two U-shaped slots for positioning and inserting/extracting (attaching/detaching) a cartridge are provided for each color. The right holder 304 is also provided with another U-shaped slot for placing the shaft of the developing roller 3*a*. This U-shaped slot is not used for positioning but for connecting to and disconnecting from the drive system.

The drum shaft 1R of the drum held by the cartridge PM is rotatably supported in curved surface portion 304*f* of the U-shaped slot of the right holder 304, thus determining the position of the drum 1. The boss 301R of the development unit 301 of the cartridge PM fits into regulation portions 304*e* as straight portions of the U-shaped slot of the right holder 304, thus regulating the rotation of the center of the drum 1 in the cartridge PM.

In this way, the position of the cartridge PM relative to the apparatus main body 100*a* is determined. Configurations for opening and closing the door 30 and for connecting and disconnecting the drive of the drum 1 and the developing roller 3*a* are similar to those according to first example embodiment, and redundant descriptions thereof will be omitted.

Figure 22:
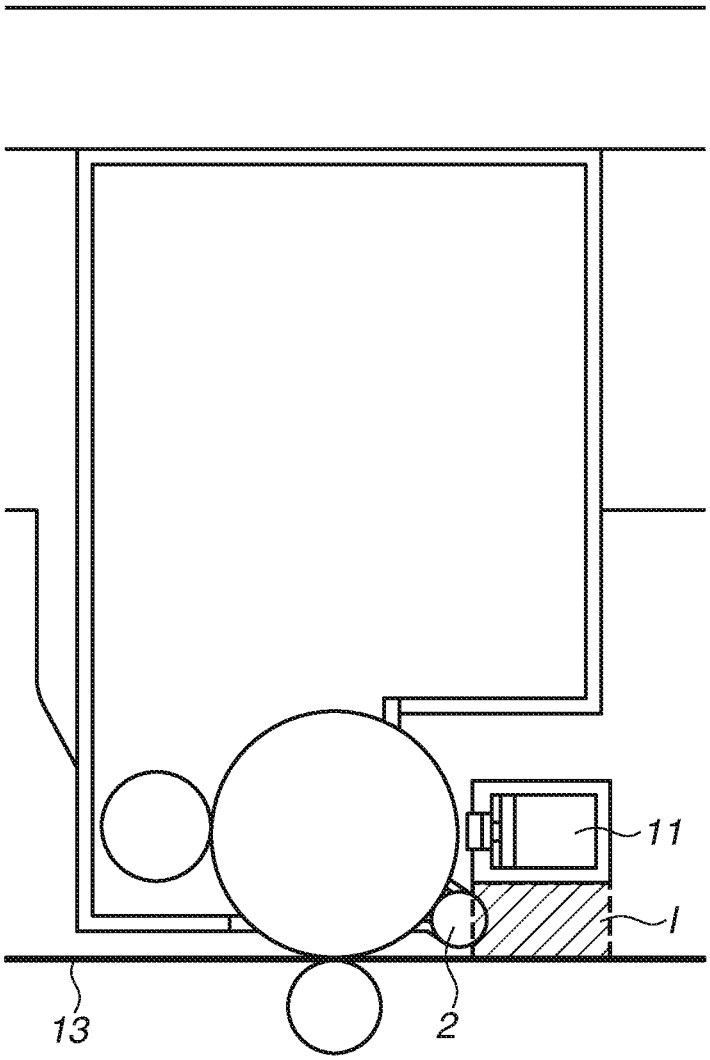
FIG. 22 illustrates a relation between a LED unit and a charging roller in the image forming apparatus according to the second example embodiment.

Lastly, a relation between the LED units 11 fixed to the apparatus main body 100*a* and the attachment/detachment of a cartridge P will be described below. According to the present example embodiment, the cartridge P holds the charging roller 2. Because of the image forming process, the charging roller 2 needs to be disposed on the upstream side of the LED unit 11 in contact with the drum 1. Since the LED unit 11 needs to be disposed close to the drum 1 as described above, the LED unit 11 and the charging roller 2 are disposed in a positional relation as illustrated in FIG. 22. FIG. 22 illustrates an area where light of the LED unit 11 is projected on the belt 13, and the charging roller 2 is disposed within the area.

More specifically, when projecting the light of the LED unit 11 in the second direction (vertical direction) connecting the center position of the drum 1 and the center position of the transfer roller 17 at the time of image formation within a section perpendicularly intersecting with the rotational shaft of the drum 1, the charging roller 2 exists as a part of a charge member in the area on which the light of the LED unit 11 is projected. This means that the cartridge P cannot inserted/extracted (attached/detached) in one direction as in first example embodiment. Therefore, it is necessary to insert the cartridge P into the apparatus main body 100*a* while getting the charging roller 2 into under the LED unit 11.

A specific method is illustrated in FIGS. 23A to 23C. FIGS. 23A to 23C are enlarged sectional views illustrating a state where the cartridge P is replaced. While FIGS. 23A to 23C illustrate a relation between the cartridge P and the right holder 304, the left holder 303 also has a similar configuration. FIG. 23A illustrates a state before a cartridge P is attached to the attachment position, FIG. 23B illustrates a state where the cartridge P is regulated to move only 1*n* two directions by regulation portions 304*e* and 304*g*, and FIG. 23C illustrates a state where the cartridge P has been attached to the attachment position.

As the cartridge P is inserted into the apparatus main body 100*a*, the drum shaft 1R of the drum 1 held by the cartridge PM enters the regulation portion 304*f* of the right holder 304, into a first area. In the first area, an attachment/detachment passage has the vertical direction (second direction) as an attachment/detachment direction. As the cartridge P is further inserted, the boss 301R of the cartridge P and the drum shaft 1R come in contact with the regulation portions 304*e* and 304*g* of the right holder 304, respectively (the state illustrated in FIG. 23B).

As the cartridge P is still further inserted, the cartridge P becomes movable only in the J and K directions illustrated in FIG. 23B. More specifically, the right holder 304 is provided with second area as an attachment/detachment passage connecting with the first area. The second area has a direction (third direction) intersecting with the vertical direction (second direction) as an attachment/detachment direction.

Thus, the insertion/extraction direction of the cartridge P is regulated using the regulation portions 304*e* and 304*g* in this way, so that the drum 1 and the charging roller 2 can be prevented from contacting the LED unit 11. This regulation prevents the surfaces of the drum 1 and the charging roller 2 from being damaged and prevents the LED unit 11 from breaking down.

Further, regulating the cartridge P to a certain extent improves usability. When the user starts the insertion of the cartridge P into the apparatus main body 100*a* (the state illustrated in FIG. 22A), the user can insert the cartridge P while freely moving it. Then, when the user has inserted the cartridge P into the apparatus main body 100*a* to certain extent, the position of the cartridge P can be guided to the attachment position (the state illustrated in FIG. 23B).

Then, the cartridge P is stopped at the attachment posit on where an image is formed on the drum 1 (the state illustrated in FIG. 23C). Therefore, according to the present example embodiment, is possible achieve a configuration showing high usability for inserting/extracting a cartridge P without causing a damage to the cartridge P and the LED unit 11 when inserting a cartridge P.

In the above-described configuration according to present example embodiment, a charge member is integrally formed with a cartridge P to limit the locus of the photosensitive drum 1 and the charging roller 2. This limitation prevents them from contacting the LED unit 11, so that the insertion/extraction (attachment/detachment) of a cartridge P can be achieved.

This configuration makes it possible to provide an image forming apparatus capable of achieving both apparatus downsizing and high precision printing by using a light emission unit having a plurality of light emitting elements while an opening/closing member is disposed at an upper portion of the apparatus in a vertical direction. More specifically, compared with case where a light scanning apparatus (scanner) is used, the present example embodiment enables apparatus downsizing by disposing an LED array as a light emission unit close to the photosensitive drum 1. High precision printing is enabled by fixing the light emission unit to the inside of the apparatus main body 100*a*, unlike the apparatus discussed in Japanese Patent Application Laid-Open No. 2008-296379.

Further, high precision printing can guaranteed by positioning the cartridge P such that it does not hit the light emission unit fixed to the apparatus main body 100*a* when attaching/detaching a cartridge P which includes the drum 1 and the charging roller 2.

(Modifications)

While the present disclosure has specifically been described based on the above-described preferred example embodiments, the present disclosure not limited thereto but can be modified in various ways within the ambit of the appended claims.

(First Modification)

Figure 14:
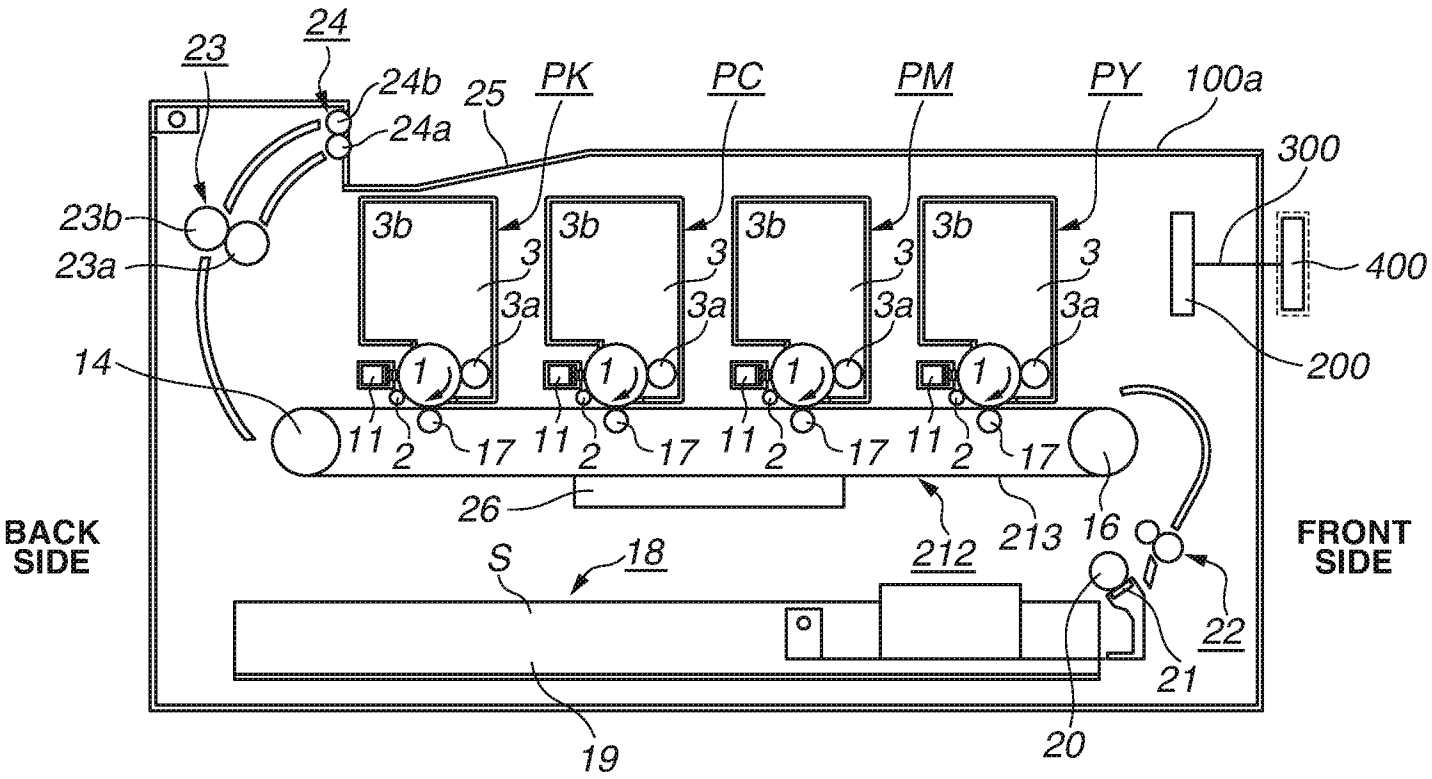
FIG. 14 is a sectional view illustrating an image forming apparatus according to a modification of the first example embodiment.

The image forming apparatuses according to the above-described example embodiments include the transfer rollers 17 for primarily transferring toner images to an intermediate transfer member (intermediate transfer belt), and the secondary transfer roller 27 for secondarily transferring to a recording material the toner image primarily transferred to the intermediate transfer member. However, the present disclosure is not limited thereto. An image forming apparatus may not include the secondary transfer roller 27 as illustrated in FIG. 14, and may directly transfer toner images to a recording material conveyed by a conveyance belt, by using the transfer rollers 17. While this configuration is applicable not only to the first example embodiment but also to the second example embodiment, a modification of the first example embodiment will be illustrated in FIG. 14 as a representative.

Referring to the modification illustrated in FIG. 14, other than a conveyance unit 212, configurations and operations are similar to those according to the first example embodiment illustrated in FIG. 2, and redundant descriptions thereof will be omitted. In the conveyance unit 212, unlike the conveyance unit 12 illustrated in FIG. 2, the drive roller 14 and the tension roller 16 move a conveyance belt 213 in circles in a stretched way. The recording material S conveyed from the sheet feed unit 18 is conveyed from the front side to the back side by the conveyance belt 213. Then, toner images are sequentially transferred from the four cartridges 2 to the recording material S, thus forming an image.

Figure 15A:
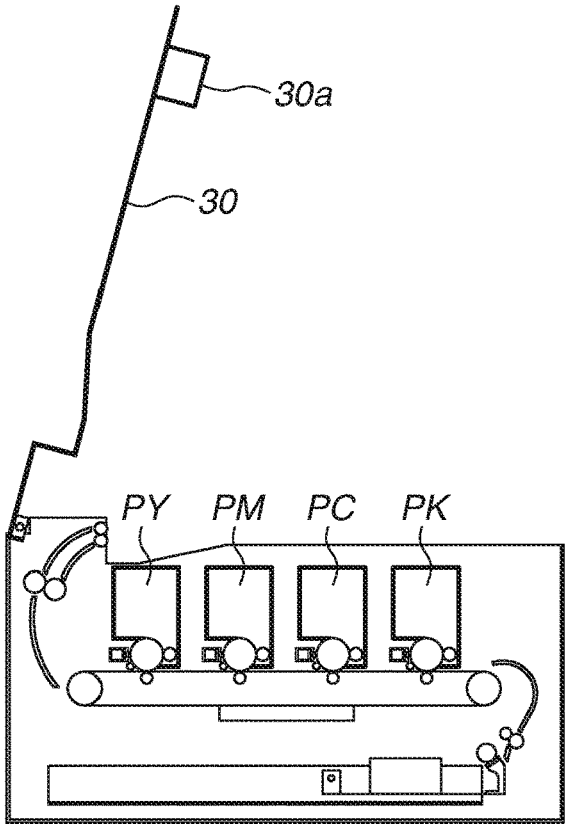
FIGS. 15A and 15B are sectional views illustrating cartridge replacement in the image forming apparatus according to the modification of the first example embodiment.
Figure 15B:
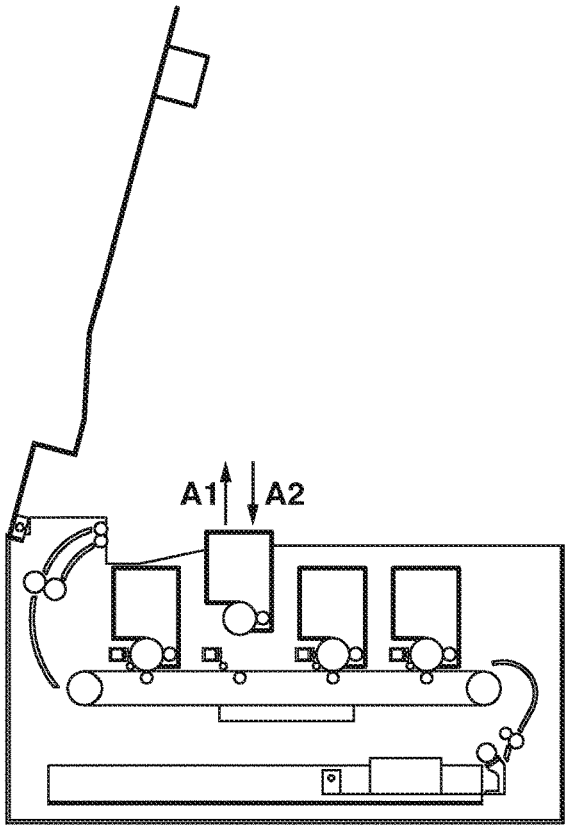

The process of forming a toner image on the drum 1 of a cartridge P is similar to the process illustrated in FIG. 2. Similar to the recording material S in FIG. 2, the recording material S with toner images transferred thereto passes through the fixing apparatus 23 and the discharging roller pair 24, and then is stacked on the discharge tray 25. As illustrated in FIGS. 15A and 15B, the modification illustrated in FIG. 14 allows the user to perform cartridge replacement in the same way as illustrated in FIGS. 9A and 9B.

(Second Modification)

Figure 16A:
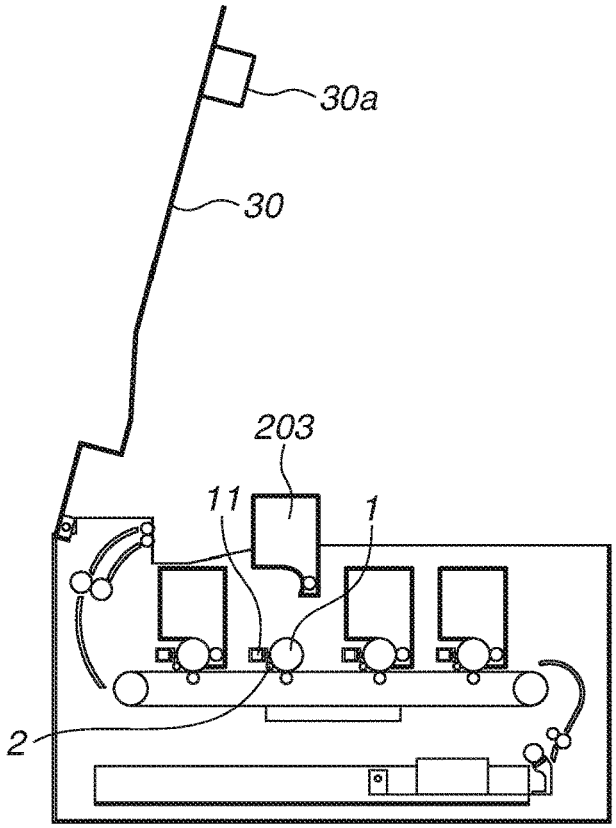
FIGS. 16A and 16B are sectional views illustrating cartridge replacement in a configuration in which a development container and a drum are separate in the image forming apparatus according the modification of the first example embodiment.
Figure 16B:
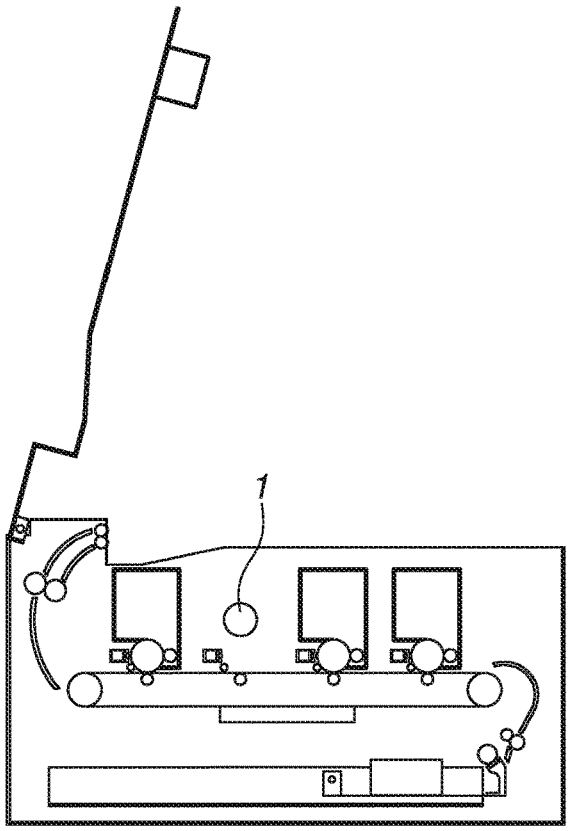

While, in the above-described example embodiments, the drum 1 and a development unit 203 are integrally formed as a process cartridge, the present disclosure is not limited thereto. More specifically, as illustrated in FIGS. 16A, 16B, and 17, the second cartridge including the development unit 203 may be separated relative to the first cartridge including the drum 1.

Figure 17:
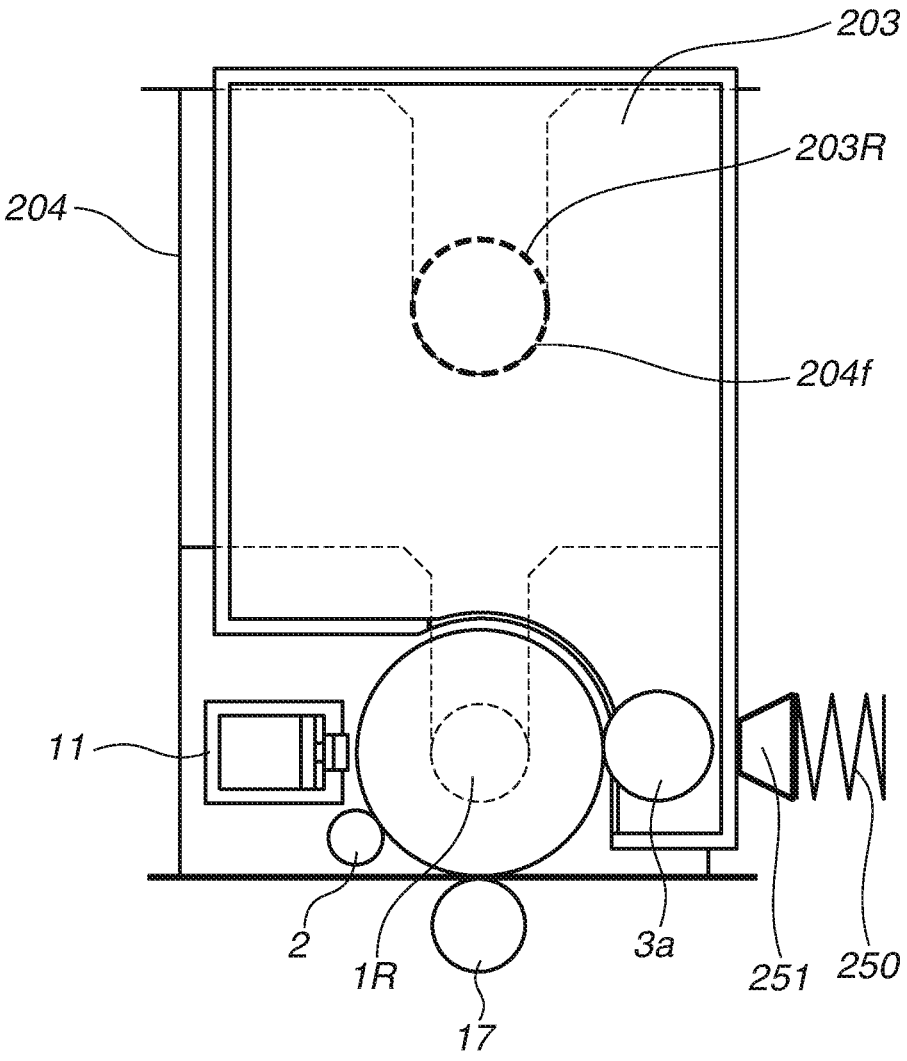
FIG. 17 is an enlarged sectional view illustrating the modification of the first example embodiment.

In positioning of the development unit 203 in this case, as illustrated in FIG. 17, a boss 203R of the development unit 203 is rotatably supported by a curved surface portion 204*f* of the U-shaped slot of a right holder 204. The urging force of a spring 250 disposed in the apparatus main body 100*a* causes a pressing cam 251 to press development unit 203 to the left. Since the development unit 203 is pressed by the urging force of the spring 250, the developing roller 3*a* can be pressed onto the drum 1.

In this case, the pressing cam 251 is configured to be movable only in the lateral direction illustrated in FIG. 17. When the door 30 is closed, as illustrated in FIG. 17, the pressing cam 251 presses the development unit 203. When the door 30 is opened, the pressing cam 251 stops pressing the development unit 203. The left holder (not illustrated) is also configured in a similar way to the above-described right holder 204.

(Third Modification)

Figure 18:
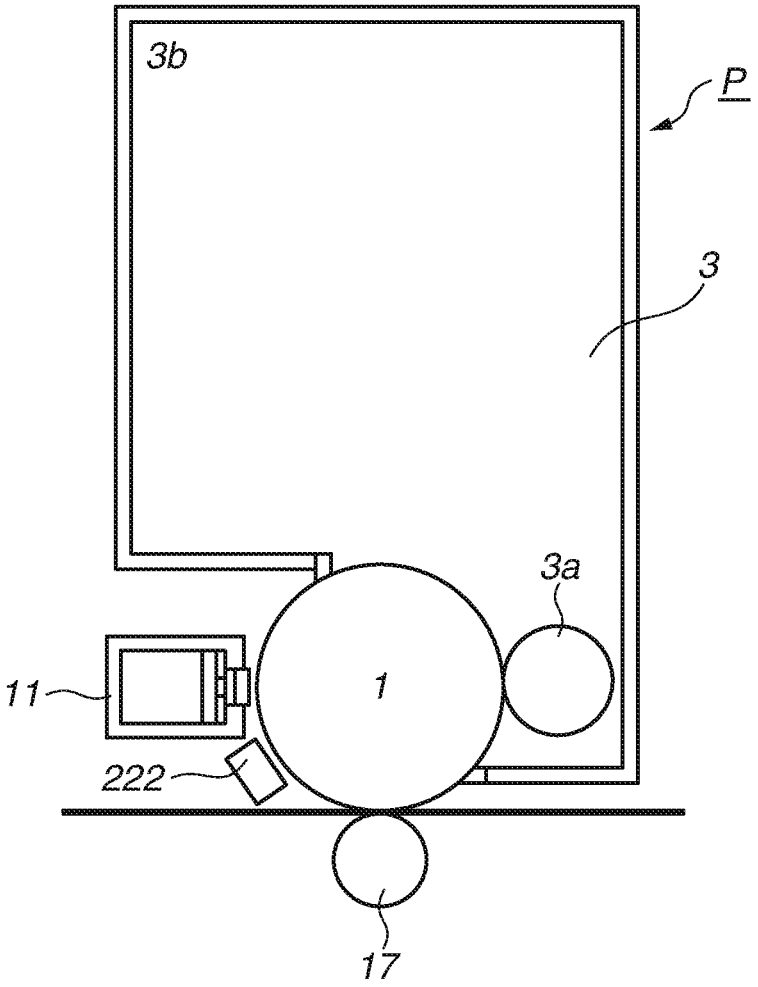
FIG. 18 is a sectional view illustrating a non-contact charging corona system.

While, in the above-described example embodiments, the charging roller 2 serves as a charge member in contact with the drum 1, a corona charging 222 can also be used as a charge member, which does not contact the drum 1, as illustrated in FIG. 18.

(Fourth Modification)

While, in the above-described example embodiments, an LED is used as a light emitting element, other light emitting elements can also be used.

While the present disclosure has been described with reference to example embodiments, it is to understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2017-033246, filed Feb. 24, 2017, which is hereby incorporated by reference herein in its entirety.

What is claimed is:

1. An image forming apparatus comprising:

an apparatus main body to which a cartridge including a photosensitive drum, a developer bearing member configured to bear a developer and a container configured to store the developer is detachably attached;

a light emission unit disposed close to the photosensitive drum, provided with a plurality of light emitting elements arranged in a rotational shaft direction of the photosensitive drum, and configured to irradiate the photosensitive drum with light to form a latent image;

a supporting member having a regulation portion configured to, when inserting the cartridge into the apparatus main body, regulate a movement in a direction perpendicularly intersecting with an insertion direction of the cartridge until an insertion of the cartridge is completed; and a belt configured to come in contact with the photosensitive drum during image formation, wherein the light emission unit is disposed upstream from the belt in the insertion direction, and wherein, in a state where the insertion of the cartridge into the apparatus main body is completed, in a normal direction to the surface of the belt, a distance from a surface of the belt to a rotational shaft of the photosensitive drum is equal to or longer than a distance from the surface of the belt to an image forming position where light emitted by the light emission unit forms an image on a surface of the photosensitive drum, and the light emission unit is disposed in a space formed by the photosensitive drum, the container and the belt and is not disposed within the photosensitive drum.

2. The image forming apparatus according to claim 1, wherein, in a state where the insertion of the cartridge into the apparatus main body is completed, with respect to the inserting direction of the cartridge, the rotational shaft of the photosensitive drum is disposed upstream of the image forming position where light emitted by the light emission unit forms an image on the surface of the photosensitive drum.

3. The image forming apparatus according to claim 1, further comprising a charge member configured to charge the photosensitive drum, wherein the charge member is disposed at a position closer to the belt than the light emission unit.

4. The image forming apparatus according to claim 1, wherein the cartridge comprises a charge member configured to charge the photosensitive drum, and wherein, in a state where the insertion of the cartridge into the apparatus main body is completed, the charge member is disposed at a position closer to the belt than the light emission unit.

5. The image forming apparatus according to claim 1, wherein the belt is an intermediate transfer member to which a developer image formed on the photosensitive drum is to be transferred.

6. The image forming apparatus according to claim 1, wherein the belt conveys a recording material, and wherein a developer image formed on the photosensitive drum is to be transferred to the conveyed recording material.

7. The image forming apparatus according to claim 1, wherein the light emission unit is supported by the supporting member.

* * * * *